US008900052B2

(12) United States Patent
Cohen et al.

(10) Patent No.: US 8,900,052 B2
(45) **Date of Patent: *Dec. 2, 2014**

(54) GAMING SYSTEM AND METHOD FOR NORMALIZING AVERAGE EXPECTED PAYOUTS TO PLAYERS

(71) Applicant: IGT, Las Vegas, NV (US)

(72) Inventors: Alexander Casey Naglestad Cohen, Los Alamitos, CA (US); Bryan D. Wolf, Reno, NV (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/140,278

(22) Filed: Dec. 24, 2013

(65) Prior Publication Data

US 2014/0106867 A1 Apr. 17, 2014

Related U.S. Application Data

(63) Continuation of application No. 13/669,887, filed on Nov. 6, 2012, now Pat. No. 8,632,396, which is a continuation of application No. 13/335,445, filed on Dec. 22, 2011, now Pat. No. 8,323,092, which is a continuation of application No. 12/613,113, filed on Nov. 5, 2009, now Pat. No. 8,092,299.

(51) Int. Cl.
*A63F 9/24* (2006.01)
*G07F 17/32* (2006.01)

(52) U.S. Cl.
CPC ..... *G07F 17/3244* (2013.01)
USPC ..... 463/25; 463/20; 463/21

(58) Field of Classification Search
USPC ..... 463/25, 20, 21
See application file for complete search history.

(56) References Cited

U.S. PATENT DOCUMENTS 4,151,404 A 4/1979 Harrington et al.
4,335,809 A 6/1982 Wain (Continued)

FOREIGN PATENT DOCUMENTS

WO WO0032286 6/2000
WO WO2006004831 1/2006

(Continued)

OTHER PUBLICATIONS

2008 Nevada Big Game Seasons and Application Regulations, written by Wildlife Administrative Services Office, published prior to Oct. 2008.

(Continued)

*Primary Examiner* — Pierre E Elisca
(74) *Attorney, Agent, or Firm* — Neal, Gerber & Eisenberg LLP

(57) ABSTRACT

The gaming system disclosed herein accounts for game play over a gaming session in determining a bonus game attribute for a triggered bonus game. The gaming system maintains a plurality of different bonus game attributes. Each different bonus game attribute is associated with a different bonus game attribute modification event and an initial probability of that bonus game attribute being selected for a play of a bonus game. For each bonus game attribute modification event that occurs, the gaming system modifies the probability that the associated bonus game attribute will be selected for a play of a bonus game. Upon an occurrence of a bonus game triggering event, the gaming system randomly selects one of the maintained bonus game attributes. The gaming system then displays a bonus game and determines a bonus game award utilizing the selected bonus game attribute.

16 Claims, 14 Drawing Sheets

(56) References Cited

U.S. PATENT DOCUMENTS 4,494,197 A 1/1985 Troy et al.
4,527,798 A 7/1985 Siekierski et al.
4,582,324 A 4/1986 Koza et al.
4,648,600 A 3/1987 Olliges
4,652,998 A 3/1987 Koza et al.
4,856,787 A 8/1989 Itkis
5,042,809 A 8/1991 Richardson
5,116,055 A 5/1992 Tracy
5,324,035 A 6/1994 Morris et al.
5,326,104 A 7/1994 Pease et al.
5,344,144 A 9/1994 Canon
5,542,669 A 8/1996 Charron et al.
5,560,603 A 10/1996 Seeling et al.
5,564,700 A 10/1996 Celona
5,645,486 A 7/1997 Nagao et al.
5,655,961 A 8/1997 Acres et al.
5,766,076 A 6/1998 Pease et al.
5,779,545 A 7/1998 Berg et al.
5,800,269 A 9/1998 Holch et al.
5,807,172 A 9/1998 Piechowiak
5,833,537 A 11/1998 Barrie
5,855,515 A 1/1999 Pease et al.
5,876,284 A 3/1999 Acres et al.
5,885,158 A 3/1999 Torango et al.
5,967,893 A 10/1999 Lawrence et al.
5,997,400 A 12/1999 Seelig et al.
5,997,401 A 12/1999 Crawford
6,001,016 A 12/1999 Walker et al.
6,062,981 A 5/2000 Luciano, Jr.
6,089,980 A 7/2000 Gauselmann
6,099,408 A 8/2000 Schneier et al.
6,102,403 A 8/2000 Kaufman
6,117,009 A 9/2000 Yoseloff
6,135,884 A 10/2000 Hedrick et al.
6,152,822 A 11/2000 Herbert
6,159,096 A 12/2000 Yoseloff
6,159,097 A 12/2000 Gura
6,179,711 B1 1/2001 Yoseloff
6,186,894 B1 2/2001 Mayeroff
6,203,010 B1 3/2001 Jorasch et al.
6,217,448 B1 4/2001 Olsen
6,220,961 B1 4/2001 Keane et al.
6,224,482 B1 5/2001 Bennett
6,231,445 B1 5/2001 Acres
6,241,608 B1 6/2001 Torango
6,244,958 B1 6/2001 Acres
6,272,223 B1 8/2001 Carlson
6,311,976 B1 11/2001 Yoseloff
6,312,333 B1 11/2001 Acres
6,328,649 B1 12/2001 Randall et al.
6,331,143 B1 12/2001 Yoseloff
6,358,147 B1 3/2002 Jaffe et al.
6,364,768 B1 4/2002 Acres et al.
6,371,852 B1 4/2002 Acres
6,375,567 B1 4/2002 Acres
6,375,569 B1 4/2002 Acres
6,419,583 B1 7/2002 Crumby et al.
6,454,651 B1 9/2002 Yoseloff
6,468,156 B1 10/2002 Hughs-Baird et al.
6,471,208 B2 10/2002 Yoseloff et al.
6,533,664 B1 3/2003 Crumby
6,569,013 B1 5/2003 Taylor
6,569,015 B1 5/2003 Baerlocher et al.
6,569,016 B1 5/2003 Baerlocher
6,648,756 B2 11/2003 Moody
6,656,048 B2 12/2003 Olsen
6,666,766 B2 12/2003 Baerlocher et al.
6,688,977 B1 2/2004 Baerlocher et al.
6,712,693 B1 3/2004 Hettinger
6,726,563 B1 4/2004 Baerlocher et al.
6,726,565 B2 4/2004 Hughs-Baird
6,746,016 B2 6/2004 Perrie et al.
6,776,711 B1 8/2004 Baerlocher
6,793,578 B2 9/2004 Luccesi et al.
6,796,902 B2 9/2004 Baerlocher et al.
6,802,778 B1 10/2004 Lemay et al.
6,910,962 B2 6/2005 Marks et al.
6,910,964 B2 6/2005 Acres
6,966,834 B1 11/2005 Johnson
6,986,055 B2 1/2006 Carlson
6,986,709 B2 1/2006 Hughs-Baird et al.
6,991,544 B2 1/2006 Soltys et al.
7,001,278 B2 2/2006 Maya et al.
7,029,395 B1 4/2006 Baerlocher
7,056,215 B1 6/2006 Olive
7,070,501 B2 7/2006 Cormack et al.
7,160,190 B2 1/2007 Baerlocher et al.
7,198,569 B2 4/2007 Wolf et al.
7,201,657 B2 4/2007 Baerlocher et al.
7,223,172 B2 5/2007 Baerlocher et al.
7,247,092 B2 7/2007 Jarvis et al.
7,258,611 B2 8/2007 Bigelow, Jr. et al.
7,278,919 B2 10/2007 Souza et al.
7,300,351 B2 11/2007 Thomas
7,306,518 B2 12/2007 Hugh-Baird et al.
7,329,177 B1 2/2008 Hui
7,329,179 B2 2/2008 Baerlocher
7,331,863 B2 2/2008 Baerlocher
7,338,370 B2 3/2008 Oles et al.
7,341,513 B2 3/2008 Cuddy et al.
7,351,146 B2 4/2008 Kaminkow
7,371,166 B1 5/2008 Webb et al.
7,399,227 B2 7/2008 Michaelson et al.
7,427,236 B2 9/2008 Kaminkow et al.
7,455,585 B2 11/2008 Englman
7,479,062 B2 1/2009 Michaelson
7,481,709 B2 1/2009 Bussick et al.
2002/0160827 A1* 10/2002 Slomiany et al. ..... 463/16
2003/0028567 A1 2/2003 Carlson
2003/0060279 A1 3/2003 Torango
2003/0186733 A1 10/2003 Wolf et al.
2003/0222402 A1 12/2003 Olive
2003/0236115 A1 12/2003 Chamberlain
2004/0002376 A1 1/2004 Swift et al.
2004/0009811 A1 1/2004 Torango
2004/0023713 A1 2/2004 Wolf et al.
2004/0038724 A1 2/2004 Asdale
2004/0063492 A1 4/2004 Baerlocher et al.
2004/0110555 A1 6/2004 DeVaull et al.
2004/0116174 A1 6/2004 Baerlocher et al.
2004/0166942 A1 8/2004 Muir
2004/0224770 A1 11/2004 Wolf et al.
2004/0235551 A1 11/2004 Walker et al.
2004/0242313 A1 12/2004 Munoz
2005/0003878 A1 1/2005 Updike
2005/0054416 A1 3/2005 Hostetler et al.
2005/0054429 A1 3/2005 Baerlocher et al.
2005/0060050 A1 3/2005 Baerlocher
2005/0096123 A1 5/2005 Cregan et al.
2005/0119047 A1 6/2005 Olive
2005/0143168 A1 6/2005 Torango
2005/0170876 A1 8/2005 Masci et al.
2005/0176488 A1 8/2005 Olive
2005/0208992 A1 9/2005 Randall
2005/0209004 A1 9/2005 Torango
2005/0282625 A1 12/2005 Nicely
2006/0009283 A1 1/2006 Englman et al.
2006/0025195 A1 2/2006 Pennington et al.
2006/0030387 A1 2/2006 Jackson
2006/0040732 A1 2/2006 Baerlocher et al.
2006/0073874 A1 4/2006 Cregan et al.
2006/0079317 A1 4/2006 Flemming et al.
2006/0111170 A1 5/2006 Hornik et al.
2006/0128457 A1 6/2006 Cannon
2006/0135243 A1 6/2006 Englman et al.
2006/0142077 A1 6/2006 Miles et al.
2006/0149561 A1 7/2006 Govender
2006/0205483 A1 9/2006 Meyer et al.
2006/0211465 A1 9/2006 Moshal
2006/0247029 A1 11/2006 Walker et al.
2007/0004505 A1 1/2007 Walker et al.
2007/0054732 A1 3/2007 Baerlocher
2007/0054733 A1 3/2007 Baerlocher
2007/0077990 A1 4/2007 Cuddy et al.

(56) References Cited

U.S. PATENT DOCUMENTS

| | | | | |
|---|---|---|---|---|
| 2007/0105619 | A1 | 5/2007 | Kniesteadt et al. | |
| 2007/0105620 | A1 | 5/2007 | Cuddy et al. | |
| 2007/0135207 | A1 | 6/2007 | Tarantino | |
| 2007/0155482 | A1* | 7/2007 | Walker et al. | 463/25 |
| 2007/0155483 | A1* | 7/2007 | Walker et al. | 463/25 |
| 2007/0155484 | A1* | 7/2007 | Walker et al. | 463/25 |
| 2007/0155485 | A1 | 7/2007 | Cuddy et al. | |
| 2007/0167217 | A1 | 7/2007 | Kaminkow et al. | |
| 2007/0178953 | A1 | 8/2007 | Torkington et al. | |
| 2007/0275777 | A1 | 11/2007 | Walker et al. | |
| 2007/0287532 | A1 | 12/2007 | Jackson | |
| 2008/0026808 | A1 | 1/2008 | Yoshizawa | |
| 2008/0026824 | A1 | 1/2008 | Muir | |
| 2008/0039173 | A1 | 2/2008 | Walther et al. | |
| 2008/0045302 | A1 | 2/2008 | Low | |
| 2008/0076503 | A1 | 3/2008 | Mattice et al. | |
| 2008/0076527 | A1 | 3/2008 | Low et al. | |
| 2008/0076531 | A1 | 3/2008 | Baerlocher et al. | |
| 2008/0076532 | A1 | 3/2008 | Graham et al. | |
| 2008/0076542 | A1 | 3/2008 | Iddings et al. | |
| 2008/0090651 | A1 | 4/2008 | Baerlocher | |
| 2008/0102916 | A1 | 5/2008 | Kovacs et al. | |
| 2008/0102920 | A1 | 5/2008 | Baerlocher | |
| 2008/0108401 | A1 | 5/2008 | Baerlocher et al. | |
| 2008/0108429 | A1 | 5/2008 | Davis et al. | |
| 2008/0113706 | A1 | 5/2008 | O'Halloran | |
| 2008/0113765 | A1 | 5/2008 | DeWaal | |
| 2008/0113771 | A1 | 5/2008 | Baerlocher et al. | |
| 2008/0139274 | A1 | 6/2008 | Baerlocher | |
| 2008/0153564 | A1 | 6/2008 | Baerlocher et al. | |
| 2008/0153584 | A1 | 6/2008 | Cuddy et al. | |
| 2008/0182650 | A1 | 7/2008 | Randall et al. | |
| 2008/0182655 | A1 | 7/2008 | DeWaal et al. | |
| 2008/0234021 | A1 | 9/2008 | Palmer et al. | |
| 2008/0248865 | A1* | 10/2008 | Tedesco et al. | 463/25 |
| 2008/0300050 | A1 | 12/2008 | Tessmer et al. | |
| 2008/0311981 | A1 | 12/2008 | Schugar | |
| 2008/0318668 | A1 | 12/2008 | Ching et al. | |
| 2009/0036202 | A1 | 2/2009 | Baerlocher et al. | |
| 2009/0042641 | A1 | 2/2009 | Anderson et al. | |
| 2009/0042644 | A1 | 2/2009 | Zielinski | |
| 2009/0042652 | A1 | 2/2009 | Baerlocher et al. | |
| 2009/0088239 | A1 | 4/2009 | Iddings et al. | |
| 2009/0104959 | A1 | 4/2009 | Caputo et al. | |
| 2009/0124316 | A1 | 5/2009 | Baerlocher et al. | |
| 2009/0124326 | A1 | 5/2009 | Caputo et al. | |

FOREIGN PATENT DOCUMENTS

| | | |
|---|---|---|
| WO | WO2006044252 | 4/2006 |
| WO | WO2006121663 | 11/2006 |
| WO | WO2007030733 | 3/2007 |
| WO | WO2007098017 | 8/2007 |
| WO | WO2007103054 | 9/2007 |
| WO | WO2007130464 | 11/2007 |
| WO | WO2008060513 | 5/2008 |
| WO | WO2008063349 | 5/2008 |
| WO | WO2008063393 | 5/2008 |

OTHER PUBLICATIONS

Cabela's Trophy Applications and Guide Service Individual State Information . . . Nevada, printed from www.Cabelas.com prior to Oct. 2008.

Cabela's Trophy Applications and Guide Service Individual State Information . . . Colorado, printed from www.Cabelas.com prior to Oct. 2008.

Cabela's Trophy Applications and Guide Service Individual State Information . . . California, printed from www.Cabelas.com prior to Oct. 2008.

Third Party Submission in Published Application Under 37 C.F.R. § 1.99 filed for U.S. Appl. No. 13/335,457, dated Jun. 18, 2012 (2 pages).

Partial U.S. Patent No. 5,645,486 submitted with Third Party Submission in Published Application Under 37 C.F.R. § 1.99 for U.S. Appl. No. 13/335,457 (3 pages).

* cited by examiner

FIG. 4A

| Initial State | | | | After Game | | |
|---|---|---|---|---|---|---|
| Bonus Game Multiplier | Weight | Probability of being selected for play of a bonus game | Bet 1 → Add weight of 1 to 1X | Bonus Game Multiplier | Weight | Probability of being selected for play of a bonus game |
| 1 | 0 | n/a | | 1 | 1 | 100% |
| 2 | 0 | n/a | | 2 | 0 | 0% |
| 3 | 0 | n/a | | 3 | 0 | 0% |
| 4 | 0 | n/a | | 4 | 0 | 0% |
| 5 | 0 | n/a | | 5 | 0 | 0% |

FIG. 4B

| Before Game | | | | After Game | | |
|---|---|---|---|---|---|---|
| Bonus Game Multiplier | Weight | Probability of being selected for play of a bonus game | Bet 2 → Add weight of 1 to 2X | Bonus Game Multiplier | Weight | Probability of being selected for play of a bonus game |
| 1 | 1 | 100% | | 1 | 1 | 50% |
| 2 | 0 | 0% | | 2 | 1 | 50% |
| 3 | 0 | 0% | | 3 | 0 | 0% |
| 4 | 0 | 0% | | 4 | 0 | 0% |
| 5 | 0 | 0% | | 5 | 0 | 0% |

FIG. 4C

| Before Game | | | | After Game | | |
|---|---|---|---|---|---|---|
| Bonus Game Multiplier | Weight | Probability of being selected for play of a bonus game | Bet 3 → Add weight of 1 to 3X | Bonus Game Multiplier | Weight | Probability of being selected for play of a bonus game |
| 1 | 103 | 38.58% | | 1 | 103 | 38.43% |
| 2 | 100 | 37.45% | | 2 | 100 | 37.31% |
| 3 | 30 | 11.24% | | 3 | 31 | 11.57% |
| 4 | 24 | 8.99% | | 4 | 24 | 8.96% |
| 5 | 10 | 3.75% | | 5 | 10 | 3.73% |

FIG. 4D

| Before Game | | |
|---|---|---|
| Bonus Game Multiplier | Weight | Probability of being selected for play of a bonus game |
| 1 | 1040 | 18.96% |
| 2 | 2030 | 37.02% |
| 3 | 2010 | 36.65% |
| 4 | 102 | 1.86% |
| 5 | 302 | 5.51% |

Bet 2 ⇨ Add weight of 1 to 2X

| After Game | | |
|---|---|---|
| Bonus Game Multiplier | Weight | Probability of being selected for play of a bonus game |
| 1 | 1040 | 18.96% |
| 2 | 2031 | 37.03% |
| 3 | 2010 | 36.65% |
| 4 | 102 | 1.86% |
| 5 | 302 | 5.51% |

FIG. 4E

| Bonus Occurs | | |
|---|---|---|
| Determine Bonus Game Multiplier based on current weights | | |
| **Weight When Bonus Occurs** | | |
| Bonus Game Multiplier | Weight | Probability of being selected for play of a bonus game |
| 1 | 1040 | 18.96% |
| 2 | 2031 | 37.03% |
| 3 | 2010 | 36.65% |
| 4 | 102 | 1.86% |
| 5 | 302 | 5.51% |

Determine Bonus Game Multiplier ⇨ Reset table to initial state

| Initial State | | |
|---|---|---|
| Bonus Game Multiplier | Weight | Probability of being selected for play of a bonus game |
| 1 | 0 | n/a |
| 2 | 0 | n/a |
| 3 | 0 | n/a |
| 4 | 0 | n/a |
| 5 | 0 | n/a |

FIG. 5A

| Initial State | | |
|---|---|---|
| Bonus Game Multiplier | Weight | Probability of being selected for play of a bonus game |
| 1 | 0 | n/a |
| 2 | 0 | n/a |
| 3 | 0 | n/a |
| 4 | 0 | n/a |
| 5 | 0 | n/a |

Bet 2 → Update Weights

| After Game | | |
|---|---|---|
| Bonus Game Multiplier | Weight | Probability of being selected for play of a bonus game |
| 1 | 1 | 25% |
| 2 | 2 | 50% |
| 3 | 1 | 25% |
| 4 | 0 | 0% |
| 5 | 0 | 0% |

FIG. 5B

| Before Game | | |
|---|---|---|
| Bonus Game Multiplier | Weight | Probability of being selected for play of a bonus game |
| 1 | 103 | 38.577% |
| 2 | 100 | 37.453% |
| 3 | 30 | 11.236% |
| 4 | 24 | 8.989% |
| 5 | 10 | 3.745% |

Bet 3 → Update Weights

| After Game | | |
|---|---|---|
| Bonus Game Multiplier | Weight | Probability of being selected for play of a bonus game |
| 1 | 103 | 38.007% |
| 2 | 101 | 37.269% |
| 3 | 32 | 11.808% |
| 4 | 25 | 9.225% |
| 5 | 10 | 3.69% |

FIG. 5C

| Before Game | | |
|---|---|---|
| Bonus Game Multiplier | Weight | Probability of being selected for play of a bonus game |
| 1 | 1040 | 18.964% |
| 2 | 2030 | 37.017% |
| 3 | 2010 | 36.652% |
| 4 | 102 | 1.86% |
| 5 | 302 | 5.507% |

Bet 2 ⇒ Update Weights

| After Game | | |
|---|---|---|
| Bonus Game Multiplier | Weight | Probability of being selected for play of a bonus game |
| 1 | 1041 | 18.969% |
| 2 | 2032 | 37.026% |
| 3 | 2011 | 36.644% |
| 4 | 102 | 1.859% |
| 5 | 302 | 5.503% |

FIG. 5D

| Bonus Occurs | | |
|---|---|---|
| Determine Bonus Game Multiplier based on current weights | | |
| Weight When Bonus Occurs | | |
| Bonus Game Multiplier | Weight | Probability of being selected for play of a bonus game |
| 1 | 1041 | 18.969% |
| 2 | 2032 | 37.026% |
| 3 | 2011 | 36.644% |
| 4 | 102 | 1.859% |
| 5 | 302 | 5.503% |

Determine Bonus Game Multiplier ⇒ Reset table to initial state

| Initial State | | |
|---|---|---|
| Bonus Game Multiplier | Weight | Probability of being selected for play of a bonus game |
| 1 | 0 | n/a |
| 2 | 0 | n/a |
| 3 | 0 | n/a |
| 4 | 0 | n/a |
| 5 | 0 | n/a |

FIG. 6A

| Wager Amount | Bonus Game Multiplier | Quantity of Occurrences of Wager Amount being Placed | Random Numbers Generated from Predefined Range of Numbers |
|---|---|---|---|
| 1 credit | 1X | 0 | 0 |
| 2 credits | 2X | 0 | 0 |
| 3 credits | 3X | 0 | 0 |
| 4 credits | 4X | 0 | 0 |
| 5 credits | 5X | 0 | 0 |

FIG. 6B

| Wager Amount | Bonus Game Multiplier | Quantity of Occurrences of Wager Amount being Placed | Random Numbers Generated from Predefined Range of Numbers |
|---|---|---|---|
| 1 credit | 1X | 1 | 3,215 |
| 2 credits | 2X | 0 | 0 |
| 3 credits | 3X | 0 | 0 |
| 4 credits | 4X | 0 | 0 |
| 5 credits | 5X | 0 | 0 |

FIG. 6C

| Wager Amount | Bonus Game Multiplier | Quantity of Occurrences of Wager Amount being Placed | Random Numbers Generated from Predefined Range of Numbers |
|---|---|---|---|
| 1 credit | 1X | 3 | 871; 3,215; 6,969 |
| 2 credits | 2X | 6 | 451; 1,663; 2,596; 2,875; 3,336; 6,698 |
| 3 credits | 3X | 0 | 0 |
| 4 credits | 4X | 4 | 15; 556; 4,897; 7,864; |
| 5 credits | 5X | 1 | 7,549 |

FIG. 7A

| Bonus Game Multiplier | Highest Random Number | Occurrences |
|---|---|---|
| 1x | 0 | 1 |
| 2x | 0 | 1 |
| 3x | 0 | 1 |
| 4x | 0 | 1 |
| 5x | 0 | 1 |

FIG. 7B

| Bonus Game Multiplier | Highest Random Number | Occurrences |
|---|---|---|
| 1x | 9864 | 1 |
| 2x | 9733 | 1 |
| 3x | 9414 | 1 |
| 4x | 9918 | 1 |
| 5x | 7897 | 1 |

FIG. 7C

| Bonus Game Multiplier | Highest Random Number | Occurrences |
|---|---|---|
| 1x | 9864 | 1 |
| 2x | 9918 | 2 |
| 3x | 9414 | 1 |
| 4x | 9918 | 1 |
| 5x | 7897 | 1 |

FIG. 8

| Bonus Game Multiplier selected | 4x |
|---|---|
| Highest Random Number Set | 4369 8464 4176 5273 |

| Current Highest Random Number Set | New Random Number Set | Comparison |
|---|---|---|
| 4369 | 3675 | New < Current. New set is less than current set. |
| 8464 | 6386 | Not applicable since first new number < first current number. |
| 4176 | 9680 | Not applicable since first new number < first current number. |
| 5273 | 8608 | Not applicable since first new number < first current number. |

| Current Highest Random Number Set | New Random Number Set | Comparison |
|---|---|---|
| 4369 | 9680 | New > Current. New set is greater than current set. |
| 8464 | 6386 | Not applicable since first new number > first current number. |
| 4176 | 3675 | Not applicable since first new number > first current number. |
| 5273 | 8608 | Not applicable since first new number > first current number. |

| Current Highest Random Number Set | New Random Number Set | Comparison |
|---|---|---|
| 4369 | 4369 | New = Current. Continue to compare next number. |
| 8464 | 6386 | New < Current. New set is less than current set. |
| 4176 | 3675 | Not applicable since first new number > first current number. |
| 5273 | 8608 | Not applicable since first new number > first current number. |

GAMING SYSTEM AND METHOD FOR NORMALIZING AVERAGE EXPECTED PAYOUTS TO PLAYERS

PRIORITY CLAIM

This application is a continuation of, claims the benefit of and priority to U.S. patent application Ser. No. 13/669,887, filed on Nov. 6, 2012, which is a continuation of, claims the benefit of and priority to U.S. patent application Ser. No. 13/335,445, filed on Dec. 22, 2011, now U.S. Pat. No. 8,323,092, which is a continuation of, claims the benefit of and priority to U.S. patent application Ser. No. 12/613,113, filed on Nov. 5, 2009, now U.S. Pat. No. 8,092,299, the entire contents of which are each incorporated by reference herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Symbols or symbol combinations which are less likely to occur usually provide higher awards.

In such known gaming machines, the amount of the wager made on the base game by the player may vary. For instance, the gaming machine may enable the player to wager a minimum number of credits, such as one credit (e.g., one penny, nickel, dime, quarter or dollar) up to a maximum number of credits, such as five credits. This wager may be made by the player a single time or multiple times in a single play of the primary game. For instance, a slot game may have one or more paylines and the slot game may enable the player to make a wager on each payline in a single play of the primary game. Thus, it is known that a gaming machine, such as a slot game, may enable players to make wagers of substantially different amounts on each play of the primary or base game ranging, for example, from 1 credit up to 125 credits (e.g., 5 credits on each of 25 separate paylines). This is also true for other wagering games, such as video draw poker, where players can wager one or more credits on each hand and where multiple hands can be played simultaneously. Accordingly, it should be appreciated that different players play at substantially different wagering amounts or levels and at substantially different rates of play.

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. Part of the enjoyment and excitement of playing certain gaming machines is the occurrence or triggering of the secondary or bonus game (even before the player knows how much the bonus award will be).

Known gaming machines also enable a player to place different wager amounts wherein the player is eligible for the bonus game on any of these different wager amounts. In certain of these gaming machines, to provide that players that wager more on a play of a base game are provided a greater bonus game award, such gaming machines increase, in proportion to the wager amount placed on the base game, the bonus game awards available for any bonus game triggered in association with that play of the base game. For example, the greater the amount a player wagers on a play of a base game, the greater a multiplier that gaming machine will utilize to determine a bonus game award for any bonus game triggered in association with that play of the base game. In certain other gaming machines, to provide that players that wager more on a play of a base game are provided a greater chance to play a bonus game (and thus obtain a bonus game award), such gaming machines increase, in proportion to the wager amount placed on the base game, the probability that a bonus game will trigger in association with that play of the base game. For example, the greater the amount a player wagers on a play of a base game, the greater the probability that the gaming machine will trigger a bonus game (and provide the player a bonus game award in the triggered bonus game) in association with that play of the base game.

While modifying the bonus game awards available in proportion to the base game wager or modifying the probability of triggering a bonus game in proportion to the base game wager provide a benefit to players that wager more on a play of a base game, such a configuration does not accurately correspond to certain players' level of game play over a designated period of time. That is, since certain players vary the amount of their wager from one play of a base game to another, such a configuration only accounts for the player's last wager amount placed and not a plurality of different wager amounts placed over the designated period of time. For example, if a player that previously wagered a first wager amount on twenty-four plays of a base game wagers a second, lesser wager amount on one play of a base game and the bonus game is triggered in association with that one, lesser wagered play of the game, the parameters of the bonus game (i.e., the bonus game awards available) will not accurately reflect the player's level of game play over the previous twenty-five plays of the base game. Accordingly, there is a need to provide a gaming system that solves such problems.

There is also a continuing need to provide new and different gaming machines and gaming systems as well as new and different ways to provide awards to players including bonus awards.

SUMMARY

In various embodiments, the gaming system and method disclosed herein accounts for a player's level of game play over a gaming session (such as a designated number of plays of a base game or a designated amount of time) in determining an average expected payout for a triggered bonus game. In one embodiment, the gaming system maintains a plurality of bonus game attributes or bonus game features. Each different bonus game attribute is associated with a different bonus game attribute modification event and an initial probability of that bonus game attribute being selected for a play of a bonus game. For each bonus game attribute modification event that occurs during the gaming session, the gaming system modifies the probability that the associated bonus game attribute will be selected for a play of a bonus game. In this embodiment, upon an occurrence of a bonus game triggering event, the gaming system randomly selects one of the maintained bonus game attributes. This random selection is based, at least in part, on the modified probabilities associated with the different bonus game attributes. The gaming system then displays a bonus game and determines a bonus game award utilizing the selected bonus game attribute. Such a configuration provides that different events which occur in association with one or more plays of one or more base games affect which of the plurality of maintained bonus game attributes are employed for a play of a bonus game to determine a bonus game award. Accordingly, as each maintained bonus game attribute or bonus game feature has or is otherwise associated with an average expected value (such that the maintained bonus game attributes in combination with the probability of each bonus game attribute being selected form an average expected payout for a play of a bonus game), modifying the probability that one or more bonus game attributes will be selected for a play of a bonus game, modifies the average expected payout for the bonus game. Thus, by accounting for the different bonus game attribute modification events that occur during a gaming session and the frequency by which such events occur during the gaming session, the gaming system and method disclosed herein equates or normalizes the average expected payout of a bonus game which occurs in association with that gaming session.

In one embodiment, a bonus game attribute modification event occurs for each wager placed and each different bonus game attribute corresponds to a different bonus game multiplier. In this embodiment, the gaming system maintains a database including a plurality of bonus game multipliers that are each associated with a different wager amount. For each wager placed on a play of a base game, the gaming system modifies the probability that the bonus game multiplier associated with that placed wager amount will be selected for a subsequent bonus game. For example, if a player places a first wager amount on a first play of a base game, the gaming system increases the probability that a subsequent bonus game will utilize a first bonus game multiplier. In this example, if the player places a second, greater wager amount on a second, subsequent play of the base game, the gaming system increases the probability that a subsequent bonus game will utilize a second, greater bonus game multiplier. Accordingly, for each wager that is placed (i.e., each bonus game attribute modification event that occurs), the gaming system amends or modifies a dynamic database of bonus game multipliers (i.e., a dynamic database of different bonus game attributes) for the subsequent play of the bonus game.

In one embodiment, if a bonus game triggering event occurs after one or more plays of the base game (and thus one or more different wager amounts placed on the base game cause the gaming system to modify the probability associated with one or more bonus game multipliers), the gaming system selects, based at least in part on the modified probabilities, one of the bonus game multipliers for the play of a bonus game. For example, if since the last play of a bonus game, the first wager amount was placed on ten plays of the base game and the second, greater wager amount was placed on twenty plays of the base game, then the second, greater bonus game multiplier will have a greater probability of being selected to utilize for the play of the triggered bonus game. The gaming system of this embodiment thus employs a bonus game multiplier randomly selected from a weighted set of bonus game multipliers (that is modified for each wager placed since the last occurrence of the bonus game).

After selecting the bonus game multiplier for the bonus game, the gaming system then determines, based at least in part on the selected bonus game multiplier, a bonus game award. The gaming system provides the determined bonus game award to a player and resets the probabilities associated with each of the bonus game multipliers. Resetting the probabilities associated with each of the bonus game multipliers (i.e., each of the maintained bonus game attributes) provides that for a subsequent trigger of a bonus game, the multiplier employed for that subsequent bonus game will be based, at least in part, on the player's wagering activity since the last play of the bonus game. Accordingly, as modifying the probability of the different bonus game multipliers being utilized for a play of a bonus game (in response to the different wager amounts placed) modifies the average expected payout for the bonus game, the gaming system and method disclosed herein provides that the average expected payout of the bonus game will be normalized across all of the varied wager amounts placed between occurrences of the bonus game. In other words, by modifying the probabilities of using different bonus game multipliers based on the wager amounts placed for a base game, the gaming system and method disclosed herein provides that the average expected bonus payout for the bonus game will be proportional or substantially proportional to the total average wager amount placed since the last play of the bonus game.

In another embodiment, rather than directly modifying the probabilities of selecting a bonus game attribute, upon an occurrence of a bonus game attribute modification event, the gaming system generates a random number from a predefined range of numbers. The generated random number is then associated with the bonus game attribute (corresponding to the bonus game attribute modification event which occurred). In this embodiment, upon an occurrence of a bonus game triggering event, the gaming system determines which one of the bonus game attributes to utilize for the bonus game based on the generated random numbers, such as by determining which of the generated random numbers is associated with the highest valued random number generated. After determining which of the plurality of maintained bonus game attributes to utilize for the bonus game, the gaming system displays a bonus game and determines a bonus game award based, at least in part, on the determined bonus game attribute.

Accordingly, the gaming system disclosed herein equates or normalizes the average expected payout of a bonus game by accounting for a player's level of game play over a gaming session (e.g., a number of games played or a designated period of time). Such a gaming system thus provides that the bonus game attribute employed for a play of a triggered bonus game (and thus the average expected bonus payout of the triggered bonus game) more accurately reflects the player's total gaming experience.

Additional features and advantages are described in, and will be apparent from, the following Detailed Description and the figures.

BRIEF DESCRIPTION OF THE FIGURES

FIGS. 4A, 4B, 4C, 4D and 4E are schematic charts of an example weighted table of bonus multipliers at different points in time as different wager amounts are placed on plays of the base game.

FIGS. 5A, 5B, 5C and 5D are schematic charts of another example weighted table of bonus multipliers at different points in time as different wager amounts are placed on plays of the base game.

FIGS. 6A, 6B and 6C are charts of an example of the random numbers generated in association with each wager amount placed on a play of the base game.

FIGS. 7A, 7B and 7C are charts of an example of the highest random number generated in associated with each wager amount available to be placed for a play of the base game.

FIG. 8 is a plurality of charts each illustrating a comparison between the current highest random number set generated and a new random number set generated.

DETAILED DESCRIPTION

The present disclosure may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
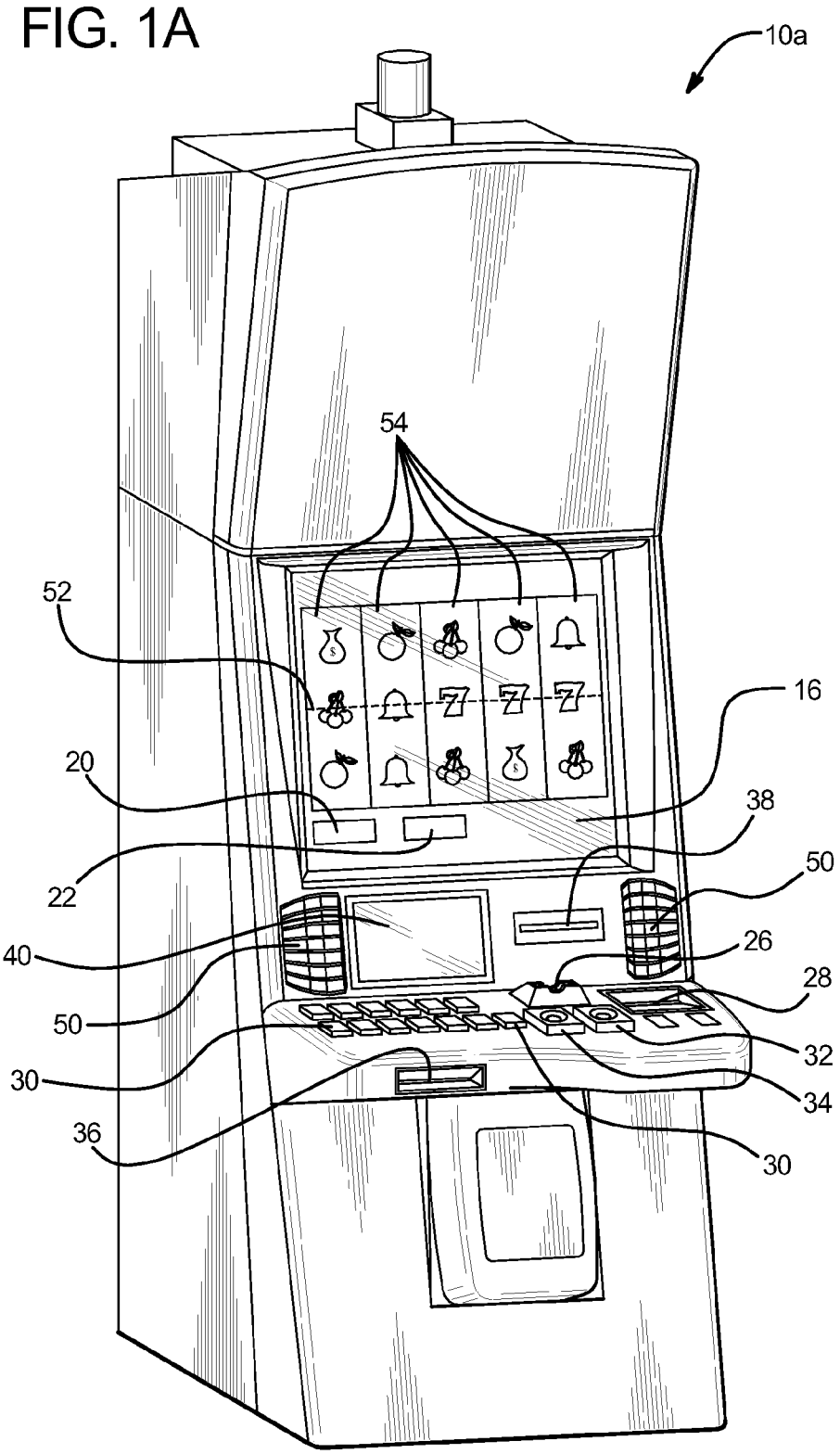
FIGS. 1A and 1B are front perspective views of alternative embodiments of gaming devices disclosed herein.
Figure 1B:
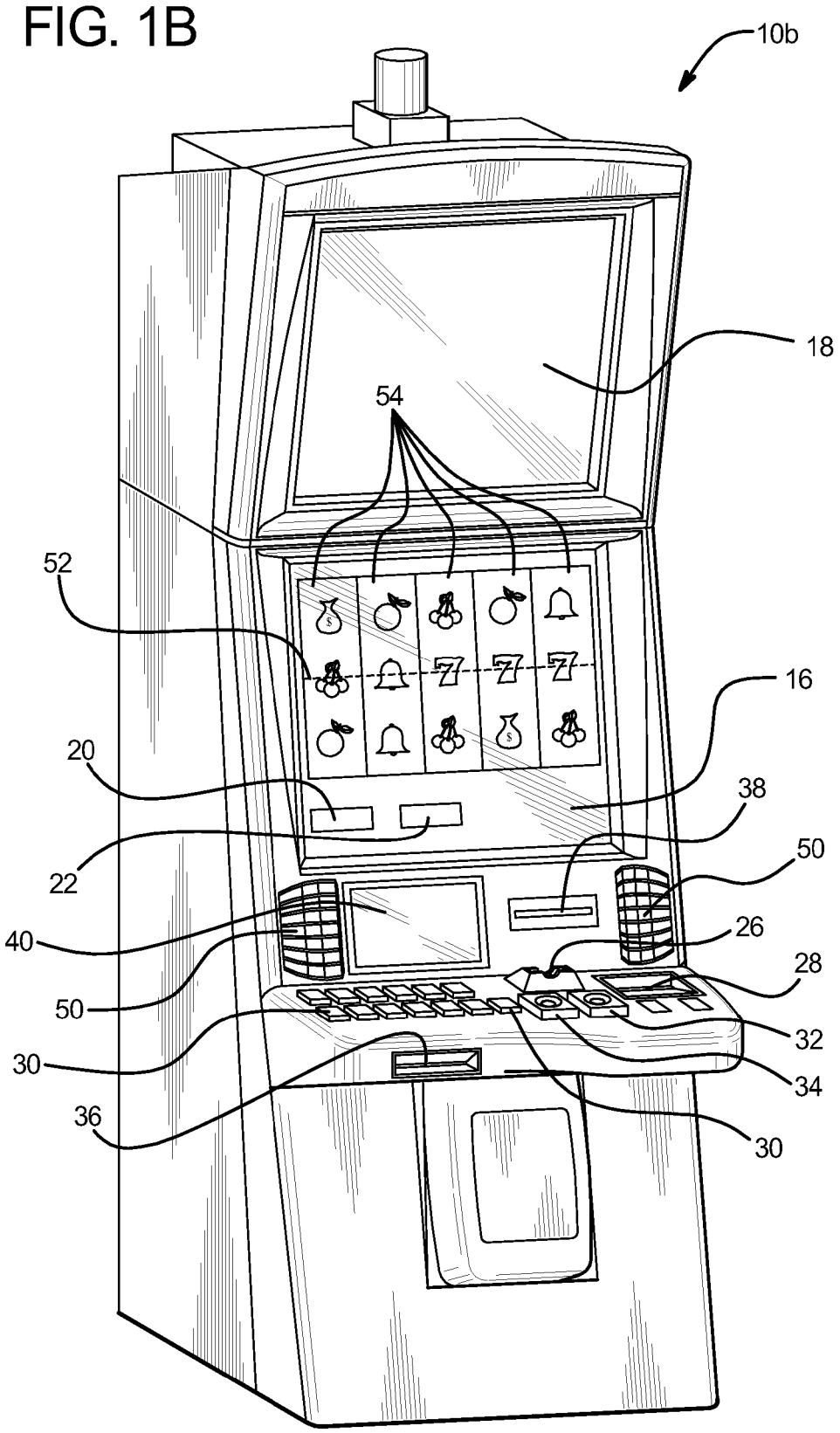

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
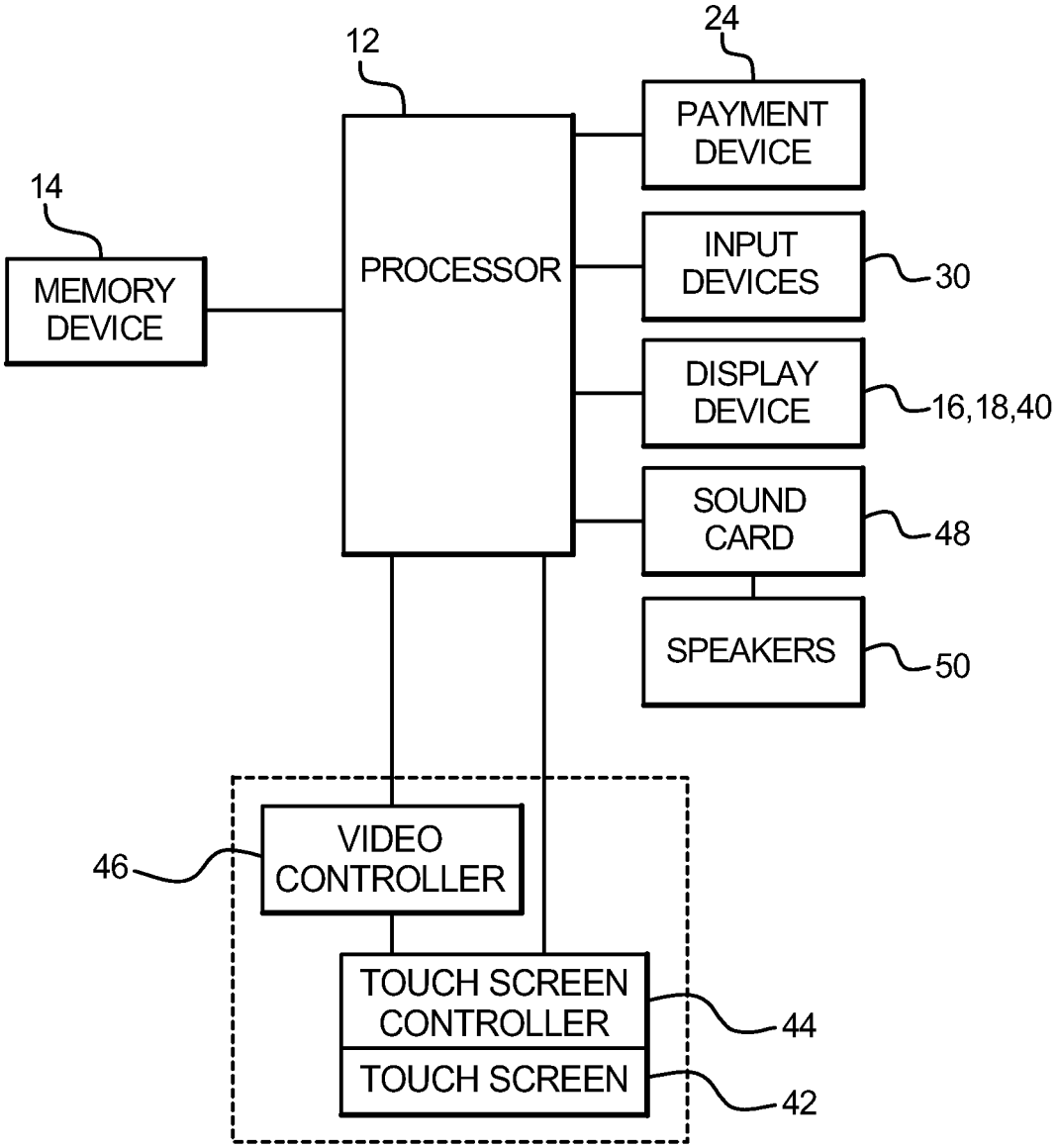
FIG. 2A is a schematic block diagram of the electronic configuration of one embodiment of a gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a hand-held device, such as a personal digital assistant (PDA), a portable computing or mobile device, or another computerized platform to implement the present disclosure. In one embodiment, the gaming device or gaming machine disclosed herein is operable over a wireless network, for example as part of a wireless gaming system. In one such embodiment, the gaming machine may be a hand-held device, a mobile device, or any other suitable wireless device that enables a player to play any suitable game at a variety of different locations. In various embodiments in which the gaming device or gaming machine is a hand-held device, a mobile device, or any other suitable wireless device, at least one memory device and at least one processor which control the game or other operations of the hand-held device, mobile device, or other suitable wireless device may be located: (a) at the hand-held device, mobile device or other suitable wireless device; (b) at a central server or central controller; or (c) any suitable combination of the central server or central controller and the hand-held device, mobile device or other suitable wireless device. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as described in more detail below, the gaming device includes a player tracking display 40 which displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more than one or all of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, a base or primary game may be a keno game wherein the gaming device displays a plurality of selectable indicia or numbers on at least one of the display devices. In this embodiment, the player selects at least one bit potentially a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or in a bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central controller 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
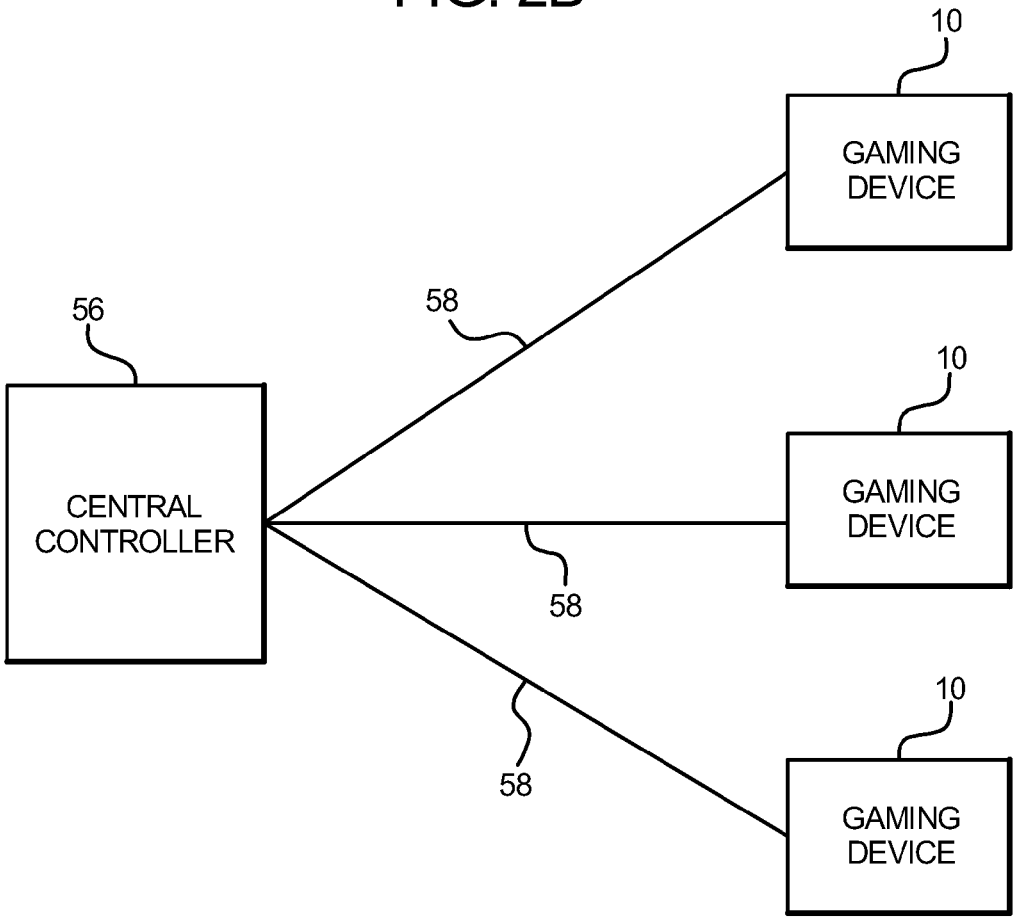
FIG. 2B is a schematic diagram of the central server in communication with a plurality of gaming machines in accordance with one embodiment of the gaming system disclosed herein.

In one embodiment, as illustrated in FIG. 2B, one or more of the gaming devices 10 are in communication with each other and/or at least one central controller 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller, central server or remote host as disclosed herein may be performed by one or more gaming device processors. It should be further appreciated that one, more or each of the functions of one or more gaming device processors as disclosed herein may be performed by the central controller, central server or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game, and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Bonus Game Attributes

Figure 3:
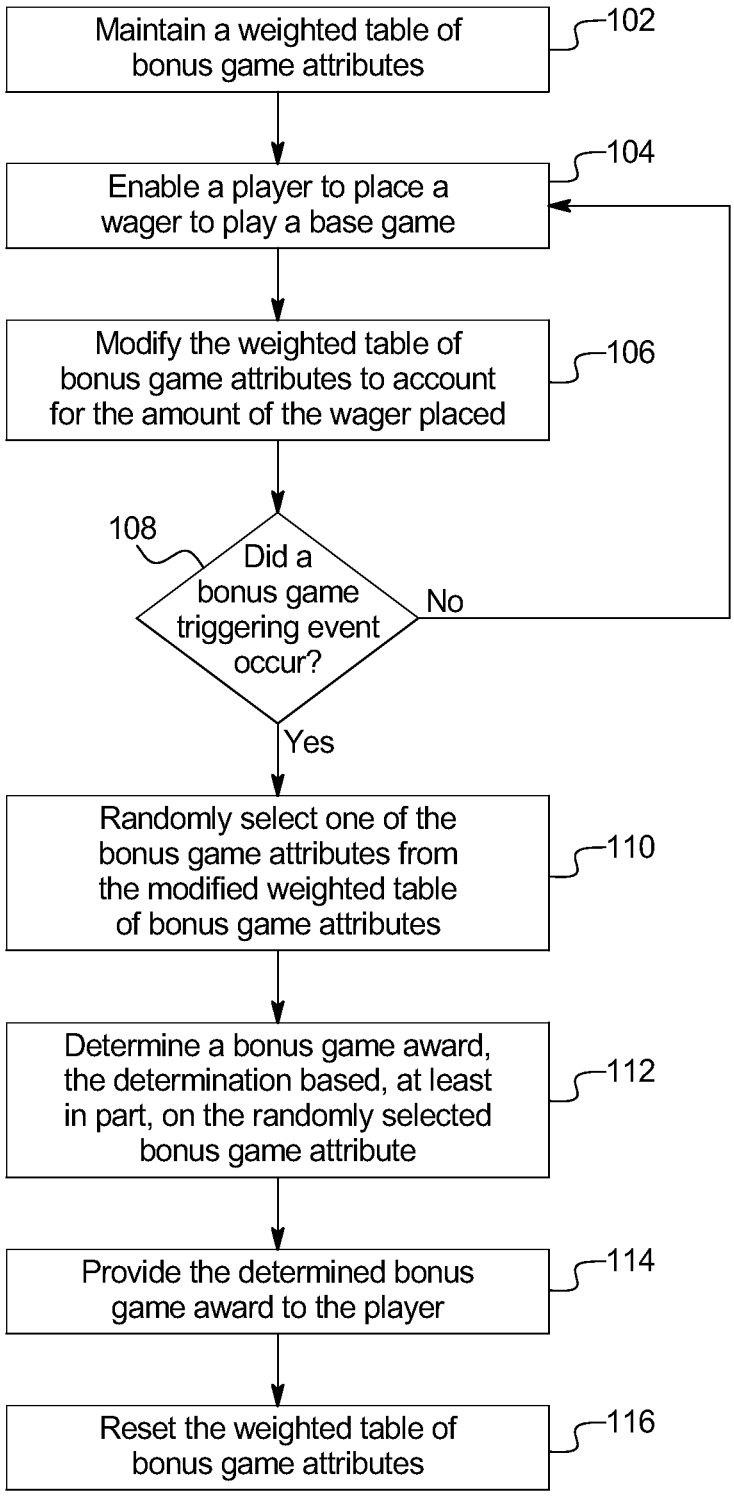
FIG. 3 is a flowchart of one embodiment of the gaming system disclosed herein and illustrating the gaming system determining, based on a weighted table of bonus game attributes, which bonus game attribute to utilize for a play of a bonus game.

Referring now to FIG. 3, in one embodiment, the gaming system maintains a weighted table or database of bonus game attributes as indicated in block 102. In one such embodiment, each different bonus game attribute represents a different bonus game multiplier that may be employed for a play of a subsequent bonus game.

In one embodiment, each different bonus game attribute is associated with a different wager amount. In this embodiment, the gaming system enables a player to place a wager to play a base game as described above and as indicated in block 104. After the player places the wager on the base game, the gaming system modifies the weighted table of bonus game attributes to account for the amount of the wager placed as indicated in block 106. That is, for each wager placed on a play of a base game, the gaming system modifies the probability that the bonus game attribute associated with that placed wager amount will be selected for a subsequent bonus game.

For example, as seen in FIG. 4A, the gaming system maintained table of bonus game attributes is represented as a maintained table of bonus game multipliers. Each different wager amount is associated with a different bonus game multiplier (i.e., a wager amount of one credit per payline is associated with a bonus game multiplier of 1×, a wager amount of two credits per payline is associated with a bonus game multiplier of 2×, etc). At a first point in time associated with an initial or reset state of the maintained table, each bonus game multiplier has a relative probability of being selected for a play of a triggered bonus game. In this example, in response to the player placing a wager of one credit per payline on the play of the base game at a second point in time, the gaming system increases the weighting of the associated bonus game multiplier of 1×. Increasing the weighting of the bonus game multiplier associated with the placed wager amount increases the probability that the associated bonus game multiplier will be subsequently selected for a subsequent play of a bonus game. In this illustrated example, since only a single wager amount has been placed to play the base game at this point in time, there is a 100% probability that, if a bonus game is played before another base game wager is placed, the bonus game multiplier associated with that wager amount will be selected for the bonus game (and thus a 0% probability that, if a bonus game is played before another base game wager is placed, the bonus game multipliers associated with other non-placed wager amounts will be selected for the bonus game).

After modifying the weighted table of bonus game attributes to account for the amount of the wager placed, the gaming system determines if a bonus game triggering event occurred as indicated in diamond 108 of FIG. 3. If the gaming system determines that the bonus game triggering event does not occur, the gaming system enables the player to place another wager to play the base game (as indicated in block 104) and proceeds as described above until the gaming system determines that the bonus game triggering event occurs.

For example, as seen in FIG. 4B, after determining that the bonus game triggering event does not occur and in response to the player placing a wager of two credits per payline on the play of the base game at a third point in time, the gaming system increases the weighting of the associated bonus game multiplier of 2× (which is associated with the placed wager amount of two credits per payline). Increasing the weighting of the bonus game multiplier associated with the placed wager amount of 2× not only increases the probability that the associated bonus game multiplier will be subsequently selected for a subsequent play of a bonus game, but also decreases the probability that the bonus game multipliers associated with other non-placed wager amounts will be subsequently selected for a subsequent play of a bonus game. In this example, since two different wager amounts have been placed on the two plays the base game, if a bonus game is played before another base game wager is placed, there is a 50% probability that the 1× bonus game multiplier associated with the first placed wager amount of one credit will be selected for the bonus game and a 50% probability that the 2× bonus game multiplier associated with the second placed wager amount of two credits will be selected for the bonus game (and thus a 0% probability that, if a bonus game is played before another base game wager is placed, the bonus game multipliers associated with other non-placed wager amounts will be selected for the bonus game). Such a configuration provides that for each wager that is placed, the gaming system amends or modifies a weighted set of bonus game multipliers (i.e., a weighted set of bonus game attributes) for a subsequent play of the bonus game.

Continuing with this example, as illustrated in FIG. 4C, at a fourth point in time after a number of different wager amounts have been placed on a number of plays of the base game, and in response to the player placing a wager of three credits per payline on the play of the base game at this point in time, the gaming system increases the weighting of the associated bonus game multiplier of 3×. Increasing the weighting of the bonus game multiplier associated with the placed wager amount of 3× not only increases the probability that the associated bonus game multiplier will be subsequently selected for a subsequent play of a bonus game, but also decreases the probability that the bonus game multipliers associated with other non-placed wager amounts will be subsequently selected for a subsequent play of a bonus game.

As further seen in this example, as illustrated in FIG. 4D, at a fifth point in time after a number of different wager amounts have been placed on a number of additional plays of the base game, and in response to the player placing a wager of two credits per payline on the play of the base game at this point in time, the gaming system increases the weighting of the associated bonus game multiplier of 2×. Increasing the weighting of the bonus game multiplier associated with the placed wager amount of 2× not only increases the probability that the associated bonus game multiplier will be subsequently selected for a subsequent play of a bonus game, but also decreases the probability that the bonus game multipliers associated with other non-placed wager amounts will be subsequently selected for a subsequent play of a bonus game.

Referring back to FIG. 3, if the gaming system determines that the bonus game triggering event occurs, as indicated in block 110, the gaming system randomly selects one of the bonus game attributes from the then currently modified weighted table of bonus game attributes. In this embodiment, which bonus game attribute is selected is based on the different modified probabilities associated with the bonus game attributes. Thus, which bonus game attribute is selected is based, at least in part, on the different wager amounts which have been placed on the base game since the last occurrence of the bonus game triggering event.

It should be appreciated that each maintained bonus game attribute or bonus game feature has or is otherwise associated with an average expected value. Accordingly, by modifying the probability that one or more bonus game attributes will be selected for a play of a bonus game, the gaming system disclosed herein modifies the average expected payout for the bonus game. Such a configuration equates or normalizes the average expected payout of a bonus game by accounting for a player's level of game play over a gaming session. This provides that the bonus game attribute employed for a play of a triggered bonus game (and thus the average expected bonus payout of that triggered bonus game) more accurately reflects the player's total gaming experience. In other words, by modifying the probabilities of using different bonus game attributes based on the wager amounts placed for a base game, the gaming system and method disclosed herein provides that the average expected bonus payout for the bonus game will be proportional or substantially proportional to the total average wager amount placed since the last play of the bonus game.

For example, as seen in FIG. 4E, when the bonus game triggering condition occurs at a sixth point in time, the gaming system randomly selects one of the bonus game multipliers based on the then current weighted table of bonus game multipliers. In this example, according to the then current weighted table of bonus game multipliers:

(i) the wager amount of one credit per payline was placed on one-thousand-forty plays of the base game since the last play of the bonus game and thus, based on these plays of the base game compared to the total number of plays of the base game since the last play of the bonus game, the 1× bonus game multiplier has a 18.9% chance of being selected, (ii) the wager amount of two credits per payline was placed on two-thousand-thirty-one plays of the base game since the last play of the bonus game and, based on these plays of the base game compared to the total number of plays of the base game since the last play of the bonus game, the 2× bonus game multiplier has a 37.0% chance of being selected, (iii) the wager amount of three credits per payline was placed on two-thousand-ten plays of the base game since the last play of the bonus game and, based on these plays of the base game compared to the total number of plays of the base game since the last play of the bonus game, the 3× bonus game multiplier has a 36.6% chance of being selected, (iv) the wager amount of four credits per payline was placed on one-hundred-two plays of the base game since the last play of the bonus game and, based on these plays of the base game compared to the total number of plays of the base game since the last play of the bonus game, the 4× bonus game multiplier has a 1.8% chance of being selected, and (v) the wager amount of five credits per payline was placed on three-hundred-two plays of the base game since the last play of the bonus game and, based on these plays of the base game compared to the total number of plays of the base game since the last play of the bonus game, the 5× bonus game multiplier has a 5.5% chance of being selected.

As seen in this example, since the wager amount of two credits per payline was the most frequently placed wager amount since the last occurrence of the bonus game trigger, the bonus game multiplier of 2× associated with this wager amount has the highest probability of being selected. Moreover, as the wager amount of four credits per payline was the least frequently placed wager amount since the last occurrence of the bonus game trigger, the bonus game multiplier of 4× associated with this wager amount has the lowest probability of being selected. Accordingly, this example of the gaming system illustrates that the probability of each bonus game multiplier being selected is proportional or substantially proportional to the different wager amounts placed since the last play of the bonus game.

After randomly selecting one of the bonus game attributes for the triggered bonus game, as indicated in block 112 of FIG. 3, the gaming system determines a bonus game award, wherein the determination is based, at least in part, on the randomly selected bonus game attribute. The gaming system then provides the determined bonus game award to the player as indicated in block 114. For example, if the gaming system selects the bonus game multiplier of 3× (which, based on the placed wager amounts of 3 credits is associated with a 36.6% probability of being selected), the gaming system applies this bonus game multiplier to any award determined for the play of the triggered bonus game to result in a modified bonus game award. The gaming system of this example then provides this modified bonus game award to the player.

Referring back to FIG. 3, after providing the determined bonus game award to the player, the gaming system resets the weighted table of bonus game attributes as indicated in block 116. That is, the gaming system resets the modified probability of being selected associated with each of the bonus game attributes of the maintained table. For example, as seen in FIG. 4E, the gaming system resets the weighted table of bonus event multipliers to the initial or reset state described above. For this illustrated embodiment, resetting of the weighted table ensures that the bonus game attribute selected for the next play of the bonus game will account for only the wagers placed on the plays of the base game since the most recent play of the bonus game (and not since any earlier plays of the bonus game). This configuration provides that the average expected payout of the bonus game will be normalized across all of the varied wager amounts placed between occurrences of the bonus game.

In one embodiment, the gaming system determines if a bonus game triggering event occurs in association with the play of the base game. In one embodiment, the gaming system determines if a bonus game triggering event occurs independent of any displayed event in any play of any base game. In another embodiment, the gaming system tracks the occurrences of one or more suitable events occurring at or in association with one or more players and/or one or more gaming devices in the gaming system and determines, based on these tracked events, whether a bonus game triggering event has occurred. In another embodiment, the gaming system defines one or more game play parameters, wherein each time a player's tracked game play activity satisfies the defined parameter, the bonus game triggering event occurs.

It should be appreciated that any suitable manner of implementing the triggered bonus game and providing the determined bonus game award to one or more players at one or more of the gaming devices may be incorporated in the gaming system disclosed herein. That is, any suitable primary game or secondary game may be utilized as the bonus game to provide one or more players of one or more gaming devices with one or more bonus event award. In different embodiments, the bonus game may incorporate any of the types of games described herein, as well as any suitable puzzle-type game, any suitable persistence game, any suitable wheel game, any suitable selection game, any suitable offer and acceptance game, any suitable cascading symbols game, any suitable ways to win game, any suitable scatter pay game, any suitable group game or any other suitable type of game.

In one embodiment, as described above, the wager amount placed on each payline causes a modification of the probability of one or more bonus game attributes being selected for a play of a subsequent bonus game. In another embodiment, the total wager amount placed in association with a play of a game causes a modification of the probability of the bonus game attribute (associated with the total wager amount placed) being selected for a play of a subsequent bonus game. In another embodiment, the gaming system includes a plurality of wager levels wherein each different bonus game attribute is associated with a different one of the wager levels. In one such embodiment, a wager level is determined, at least in part, based on the total wager amount placed in association with a play of a game. In this embodiment, a wager level is determined based on the number of paylines wagered on and the amount per payline, regardless of the configuration of the total wager. For example, a wager of one credit on fifty paylines or two credits on twenty-five paylines represents the same wager level and thus the bonus game attribute associated with each of these different wager configurations is the same. In another such embodiment, a wager level is determined based, at least in part, on the configuration of the wager placed. For example, a wager of one credit on fifty paylines is a different wager configuration and a different wager level than a wager of two credits on twenty-five paylines and thus the bonus game attribute associated with each of these different wager configurations is different. In another such embodiment, a wager level is determined based on the number of ways to win wagered on and the amount wagered on each way to win.

In one embodiment, the gaming system maintains the database of bonus game attributes for a single gaming device in the gaming system. In this embodiment, each bonus game attribute modification event (e.g., each wager amount placed) at that gaming device causes a modification of the database of bonus game attributes and if a bonus game triggering event occurs, the player currently at that gaming device participates in a bonus game utilizing the maintained database. In another embodiment, the gaming system maintains the database of bonus game attributes for a plurality of gaming devices in the gaming system. In this embodiment, each bonus game attribute modification event (e.g., each wager amount placed) at one of the gaming devices causes a modification of the database of bonus game attributes for each of the gaming devices. If a bonus game triggering event occurs, the player currently at the gaming device associated with the bonus game triggering event participates in a bonus game utilizing the maintained database. In this embodiment, a plurality of player's individual gaming experiences each influence the maintained database of bonus game attributes. For example, a first player at a first gaming device that is consistently placing a relatively low wager is benefiting from a second player at a second gaming device that is consistently placing a relatively high wager amount (and increasing the probability that the bonus game attribute associated with the relatively high wager amount will be selected upon the triggering of a bonus game).

In another embodiment, the gaming system maintains the database of bonus game attributes for a single identified player (identified through an appropriate player tracking system). In this embodiment, each bonus game attribute modification event (e.g., each wager amount placed) which occurs in association with that player (regardless of which gaming device the player is currently playing at) causes a modification of the database of bonus game attributes maintained for that player. In another embodiment, the gaming system maintains the database of bonus game attributes for a plurality of identified players (identified through an appropriate player tracking system). In this embodiment, each bonus game attribute modification event (e.g., each wager amount placed) which occurs in association with one of the identified players (regardless of which gaming device the identified player is currently playing at) causes a modification of the database of bonus game attributes maintained for each of the plurality of identified players. In this embodiment, as described above, a plurality of player's individual gaming experiences each influence the maintained database of bonus game attributes.

In one embodiment, the gaming system disclosed herein enables a player to save the current status of the maintained database of bonus game attributes. By using an appropriate player tracking system or other suitable system, the gaming system enables a player to save the current status of the maintained database of bonus game attributes. In one embodiment, the gaming system enables any saved database of bonus game attributes to be saved for a designated period of time (or a designated quantity of games played) and then if unused, any saved database of bonus game attributes will expire or reset. In such embodiments, any saved database of bonus game attributes are saved in association with a player tracking system, in association with the central server and/or in association with the individual gaming devices.

In another embodiment, upon a player initializing game play at one of the plurality of gaming devices, the gaming system attempts to identify the player. If the gaming system successfully identifies the player, the gaming system maintains the database of bonus game attributes for that identified player as described above. On the other hand, if the gaming system does not successfully identify the player, the gaming system maintains the database of bonus game attributes in association with the gaming device the unidentified player is currently playing at. In this embodiment, if the gaming system subsequently identifies the player (e.g., the player inserts a player tracking card), the gaming system mergers or otherwise combines the currently maintained database of bonus game attributes associated with the gaming device with any saved maintained database of bonus game attributes associated with the player. In one such embodiment, after the occurrence of a bonus game triggering event, the gaming system resets the modified database maintained for the gaming device the player is currently playing at and/or the modified database maintained for the identified player.

In one embodiment, the gaming devices of the gaming system maintain the database of bonus game attributes. In one such embodiment, if one or more bonus game attribute modification events occur in association with a player's gaming experience at a gaming device, the gaming device maintains the modified database of bonus game attributes until a bonus game triggering condition occurs. In another embodiment, if one or more bonus game attribute modification events occur in association with a player's gaming experience at a gaming device, the central server maintains the modified database of bonus game attributes until a bonus game triggering condition occurs. In another embodiment, the gaming devices of the gaming system and the central server jointly maintain the modified database of bonus game attributes.

In another embodiment, upon each wager amount placed, the gaming system modifies the probability of being selected associated with a plurality of different bonus game attributes (e.g., a plurality of different bonus game multipliers). In this embodiment, in addition to or as an alternative to modifying the probability of being selected associated with the bonus game attribute of the placed wager amount, the gaming system modifies the weighted table to change the probability that one or more other bonus game attributes will be selected for a subsequent bonus game. In one such embodiment, for a single wager amount placed, the gaming system modifies the probability associated with each bonus game attribute equally. In another such embodiment, for a single wager amount placed, the gaming system modifies the probability associated with one or more different bonus game attributes differently. For example, as seen in FIGS. 5A to 5D, upon the placement of a wager amount of two credits per payline, the gaming system modifies the probability that the bonus game multiplier associated with the placed wager amount of two credits per payline is modified. In this example, the gaming system also modifies the probability that the bonus game multipliers associated with the non-placed wager amounts of one credit per payline and three credits per payline are each modified. Such an embodiment provides that the single placement of a wager amount causes a modification of the probabilities associated with each of a plurality of different bonus game attributes.

In another embodiment, upon each wager amount placed, the gaming system modifies the probability of being selected associated with one or more randomly selected bonus game attributes (e.g., one or more randomly selected bonus game multipliers). In this embodiment, in addition to or as an alternative to modifying the probability of being selected associated with the bonus game attribute of the placed wager amount, the gaming system modifies the weighted table to change the probability that one or more randomly selected bonus game attributes will be selected for a subsequent bonus game.

In one embodiment, the gaming system modifies the probability of being selected with at least one of the bonus game attributes for each wager placed on each payline of a slot game (or each hand of cards on a multi-hand card game). In another embodiment, the gaming system modifies the probability of being selected with at least one of the bonus game attributes for a total wager placed on a wagering game. In another embodiment, the gaming system modifies the probability of being selected with at least one of the bonus game attributes for a designated wager placed, such as a wager at or above a wager threshold level. In another embodiment, the gaming system modifies the probability of being selected with at least one of the bonus game attributes for a designated quantity of wagers placed, such as every second wager placed.

In one embodiment, the gaming system modifies the probability of being selected with at least one of the bonus game attributes before determining if the triggering event occurred. In another embodiment, the gaming system modifies the probability of being selected with at least one of the bonus game attributes after determining if the triggering event occurs. In one such embodiment, if the triggering event occurs, prior to triggering the bonus game, the gaming system modifies, based on the player's wager, the probability of being selected with at least one of the bonus game attributes. In another such embodiment, if the triggered event occurs, then the gaming system triggers the bonus game and does not modify, based on the player's wager, the probability of being selected with at least one of the bonus game attributes.

In an alternative embodiment, in addition to or as an alternative to modifying the maintained database of bonus game attributes upon the placement of a wager amount, the gaming system modifies the maintained database of bonus game attributes upon an occurrence of a non-wagering event. In one such embodiment, the non-wagering event is any randomly occurring event, such as the generation of a designated symbol combination. In another such embodiment, the non-wagering event is any non-randomly occurring event, such as a player playing a designated number of base games within a certain amount of time. In these embodiments, the occurrence of the non-wagering event (and thus the modification of the maintained database of bonus game attributes) may not occur for each base game played, may occur for each base game played or may occur a plurality of times for each base game played. It should be appreciated that the bonus game modifications disclosed herein can be used for any variable wager game associated with a bonus game that includes a set of available award, wherein a gaming system operator or implementor can configure the bonus game to dynamically weight the different awards available for different plays of the bonus game.

In another embodiment, the gaming system maintains a plurality of databases of bonus game attributes. Each database includes the same bonus game attributes. In this embodiment, the gaming system modifies each database (i.e., modifies the probability of one or more bonus game attributes being selected for a play of a bonus game) based on a different criteria or qualification. For example, the gaming system modifies a first database based on each occurrence of a wagering event as described herein. In this example, the gaming system modifies a second, different database based on each occurrence of a randomly generated non-wagering event. In this embodiment, upon the occurrence of a bonus game triggering event, the gaming system selects one of the maintained databases and then randomly selects one of the weighted bonus game attributes for the play of the triggered bonus game.

In another embodiment, the gaming system maintains a plurality of databases of bonus game attributes. Each database includes different bonus game attributes. In this embodiment, the gaming system modifies each database (i.e., modifies the probability of one or more bonus game attributes being selected for a play of a bonus game) based on each bonus game attribute modification event which occurs. In this embodiment, upon the occurrence of a bonus game triggering event, the gaming system selects one of the maintained databases and then randomly selects one of the weighted bonus game attributes for the play of the triggered bonus game.

It should be appreciated that while the maintained bonus game attributes of the present disclosure are illustrated as bonus game multipliers in FIGS. 4A to 4E, the gaming system disclosed herein is configured to utilize any suitable feature to maintain the database of bonus game attributes. In one such embodiment, each bonus game attribute represents a different paytable that may be utilized for a play of a subsequent bonus game. For example, the bonus game employs one or more spins of a bonus wheel, wherein different characteristics of the wheel (such as the award values associated with different sections of the wheel and/or the probability of different sections of the wheel being generated) correspond to the different bonus game attributes. In another such embodiment, each bonus game attribute represents a different set or group of one or more award values, such one or more progressive awards, that become available for a play of a subsequent bonus game.

In another such embodiment, each bonus game attribute represents a different feature that may be employed for a play of a subsequent bonus game. In one example, each bonus game attribute represents a quantity of picks a player is provided in a selection bonus game. In another example, the bonus game is a free spins game wherein a first bonus game attribute corresponds to the employment of one or more expanding wild symbols in the free spins game, a second, different bonus game attribute corresponds to the employment of one or more roaming wild symbols in the free spins game and a third, different bonus game attribute corresponds to the employment of one or more expanding wild symbols and one or more roaming wild symbols in the free spins game. In another such embodiment, the gaming system maintains a database of different pluralities of symbols (i.e., different reel strips to be utilized for a free spins game) each having a different average expected payout if utilized for a play of a bonus game. In another such embodiment, the gaming system maintains a database of different bonus games, each having a different average expected payout when played. In another such embodiment, the bonus game is a group or community competition bonus game wherein each bonus game attribute corresponds to an individual player's likelihood of winning the competition bonus game.

In one alternative embodiment, after providing the determined bonus game award to the player, the gaming system resets the associated probability of being selected associated with a plurality of, but less than all of the bonus game attributes. In another embodiment, after providing the determined bonus game award to the player, the gaming system modified or partially reduces (but does not fully reset) the associated probability of being selected associated with one, more or each of the bonus game attributes. In another embodiment wherein a plurality of players contribute to the modification of the weighted table, after providing the determined bonus game award to the player, the gaming system resets the weighted table of bonus game attributes for each of the players. In another such embodiment, after providing the determined bonus game award to the player, the gaming system resets the weighted table of bonus game attributes for a plurality of, but less than all of the players.

In one embodiment, as described in the illustrated example above, each of the bonus game attributes of the maintained database is associated with a designated initial or reset probability of being selected, such as an initial zero probability of being selected. In another embodiment, one, more or each of the bonus game attributes of the maintained database is associated with a greater than zero initial or reset probability of being selected. Such an embodiment provides that one, more or each of the bonus game attributes is available to be selected for any player at any point in time. In one embodiment, the initial or reset associated probabilities of being selected associated with each of the bonus game attributes of the maintained database are the same or substantially the same. In another embodiment, the initial or reset probability of being selected associated with a plurality of the bonus game attributes of the maintained database are different. In another embodiment, the initial or reset associated probabilities of being selected associated with each of the bonus game attributes of the maintained database are different.

In another embodiment, as described above, the average expected value of the bonus game attribute associated with each wager is linearly proportioned to the amount of that wager. For example, a wager amount of one credit per payline is associated with a bonus game multiplier of 1×, a wager amount of two credits per payline is associated with a bonus game multiplier of 2×, a wager amount of three credits per payline is associated with a bonus game multiplier of 3×, a wager amount of four credits per payline is associated with a bonus game multiplier of 4×, and a wager amount of five credits per payline is associated with a bonus game multiplier of 5×. In another embodiment, the average expected value of the bonus game attribute associated with each wager is non-linearly proportioned to the amount of that wager. For example, a wager amount of one credit per payline is associated with a bonus game multiplier of 1×, a wager amount of two credits per payline is associated with a bonus game multiplier of 3×, a wager amount of three credits per payline is associated with a bonus game multiplier of 5×, a wager amount of four credits per payline is associated with a bonus game multiplier of 7×, and a wager amount of five credits per payline is associated with a bonus game multiplier of 10×. Such an embodiment provides players an additional incentive for placing the maximum wager amount per payline (to increase the probability of triggering the bonus game which utilizes a bonus game attribute having a higher average expected value).

In another embodiment, rather than directly modifying the probabilities of selecting a bonus game attribute, upon an occurrence of a bonus game attribute modification event associated with one of the bonus game attributes, the gaming system generates a random number from a predefined range of numbers for the associated bonus game attribute. For example, as seen in FIG. 6A and as described above, each bonus game attribute is represented as a bonus game multiplier which is associated with a different wager amount (i.e., a wager amount of one credit is associated with a bonus game multiplier of 1×, a wager amount of two credits is associated with a bonus game multiplier of 2×, etc). In this example, at a first point in time associated with an initial or reset state, no wager amounts have been placed and thus no random numbers have been generated. As seen in FIG. 6B, in response to the player placing a wager of one credit on the play of the base game at a second point in time, for the bonus game multiplier of 1× associated with the wager amount placed, the gaming system randomly generates 3215 from the range of numbers between 0 to 9,999. In this illustrated example, since only a single wager amount has been placed to play the base game and only one of the generated random numbers is subsequently selected to determine the bonus game attribute of a subsequently triggered bonus game (as described below), there is a 100% probability that, if a bonus game is played before another base game wager is placed, the bonus game multiplier associated with that wager amount will be selected for the bonus game (and thus a 0% probability that, if a bonus game is played before another base game wager is placed, the bonus game multipliers associated with other non-placed wager amounts will be selected for the bonus game). It should be appreciated that in other embodiments, the ratio of random numbers generated to occurrences of bonus game attribute modification events may vary from a one to one ratio to a one to many ratio. In one such embodiment, the gaming system generates a plurality of random numbers for each bonus game attribute modification event which occurs. In another such embodiment, the gaming system generates a random number for a plurality of bonus game attribute modification events which occur.

After randomly generating a number from a predefined range for the occurrence of the bonus game attribute modification event, the gaming system determines if a bonus game triggering event occurred as described above. If the gaming system determines that the bonus game triggering event does not occur, the gaming system enables the player to place another wager to play the base game and proceeds with generating a random number from a predefined range of numbers for each bonus game attribute modification event which occurs until the gaming system determines that the bonus game triggering event occurs.

For example, as seen in FIG. 6C, after a number of different wager amounts have been placed on a number of plays of the base game: (i) the wager amount of one credit was placed three times and the gaming system randomly generated and accumulated three numbers between 0 to 9,999 for the associated bonus game multiplier of 1×; (ii) the wager amount of two credits was placed six times and the gaming system randomly generated and accumulated six numbers between 0 to 9,999 for the associated bonus game multiplier of 2×; (iii) the wager amount of three credits was placed zero times and the gaming system randomly generated and accumulated zero numbers between 0 to 9,999 for the associated bonus game multiplier of 3×; (iv) the wager amount of four credits was placed four times and the gaming system randomly generated and accumulated four numbers between 0 to 9,999 for the associated bonus game multiplier of 4×; and (v) the wager amount of five credits was placed one time and the gaming system randomly generated and accumulated one number between 0 to 9,999 for the associated bonus game multiplier of 5×.

In one embodiment, upon an occurrence of a bonus game triggering event, the gaming system determines which one of the bonus game attributes to utilize for the bonus game based on the generated random numbers. In one embodiment, after generating a separate random number for each bonus game attribute modification event which occurs (for each bonus game attribute), the gaming system determines which one of the bonus game attributes is a designated or winning bonus game attribute. In one such embodiment, the gaming system compares each of the randomly generated numbers generated to determine which bonus game attribute is associated with a designated or winning random number and will thus be utilized for the play of the triggered bonus game. It should be appreciated that since the random numbers are each drawn from the same range of numbers, this random number draw achieves the same probabilities of selecting a bonus game attribute to utilize for the play of the triggered bonus game as the above-described weighted table of bonus game attributes. That is, out of N random numbers drawn from the same range, each random number has the same 1/N probability of being considered the designated or winning random number.

In one such embodiment, the gaming system sorts the generated random numbers and determines that the bonus game attribute associated with the highest generated random number will be utilized for the play of the triggered bonus game. In another such embodiment, the gaming system sorts the generated random numbers and determines that the bonus game attribute associated with the lowest generated random number will be utilized for the play of the triggered bonus game. In another such embodiment, the gaming system sorts the generated random numbers and determines that the bonus game attribute associated with the generated random number that is closest to a supplemental randomly generated number will be utilized for the play of the triggered bonus game. It should be appreciated that this embodiment includes an additional level of randomness because not only is a random number generated for each bonus game attribute modification event which occurs, but a random number is further generated for the supplemental number (which the randomly generated numbers associated with the bonus game attributes are compared to).

In another such embodiment, the gaming system sorts the generated random numbers and determines that the bonus game attribute associated with the generated random number that is closest to a mode number will be utilized for the play of the triggered bonus game. In another such embodiment, the gaming system sorts the generated random numbers and determines that the bonus game attribute associated with the generated random number that is closest to a mean number will be utilized for the play of the triggered bonus game. In another such embodiment, the gaming system sorts the generated random numbers and determines that the bonus game attribute associated with the generated random number that is closest to a median number will be utilized for the play of the triggered bonus game.

Utilizing the example described above, if the highest randomly generated number is considered the designated or winning random number, then as seen in FIG. 6C, the gaming system determines that the random number of seven-thousand-eight-hundred-sixty-four (7864) generated in association with one of the four wager amounts of four credits placed is the designated or winning random number. Accordingly, in this example, the gaming system determines that the bonus game multiplier of 4× (associated with the wager amount of four credits) is the designated or winning bonus game attribute to be utilized for the play of the triggered bonus game.

In one embodiment, determining one of the bonus game attribute to utilize for the play of the triggered bonus game includes determining if a plurality of different bonus game attributes are each determined to be utilized for the play of the triggered bonus game. That is, if the gaming system determines that a plurality of the randomly generated numbers are each the designated or winning random number (i.e., a tie occurs between the random numbers generated), the gaming system determines that a plurality of bonus game attributes should each be utilized for the play of the triggered bonus game.

In one embodiment, if the gaming system determines that a plurality of different bonus game attribute should each be utilized for the play of the triggered bonus game, the gaming system will regenerate random numbers (from the predefined range of numbers) for each generated random number that is considered the designated or winning random number. The gaming system then determines which one of these regenerated random numbers is considered the designated or winning random number (and thus which bonus game attribute will be utilized for the play of the triggered bonus game). Following the determination of one of these regenerated random numbers as the designated or winning random number, the gaming system again determines if a plurality of regenerated random numbers are each still determined to be considered the designated or winning random number. This process continues until the gaming system determines that a single random number associated with a single bonus game attribute is the designated random number (and that the single bonus game attribute will be utilized for the play of the triggered bonus game).

In one such embodiment, if the gaming system determines that a plurality of randomly generated numbers are each considered the designated or winning random number, the gaming system ignores the bonus game attributes associated with the non-designated random numbers and determines which one of the remaining bonus game attributes will be utilized for the play of the triggered bonus game. In this embodiment, the gaming system regenerates random numbers only for the bonus game attributes which one or more generated random numbers was previously determined to be the designated or winning random number. In other words, if a bonus game attribute was not determined to be utilized for the play of the triggered bonus game, that bonus game attribute cannot be subsequently determined to generate a random number considered the designated or winning random number. In another embodiment, if the gaming system determines that a plurality of randomly generated numbers are each considered the designated or winning random number, the gaming system regenerates a random number for each bonus game attribute modification event which occurred and determines which one of the regenerated random number is considered the designated or winning random number.

It should be appreciated that the size of the predefined range determines the frequency which a plurality of bonus game attributes will each be determined to be utilized for the play of the triggered bonus game. That is, the size of the predefined range determines the probability that a tie occurs between the random numbers generated for a plurality of bonus game attributes. Thus, if a gaming system operator wants less frequent occurrences of a plurality of bonus game attributes each being determined to be utilized for the play of the triggered bonus game, the gaming system operator will include larger predefined ranges of numbers for the random numbers to be selected from. In other words, the greater the predefined range, the less frequently, on average, that a tie occurs between the random numbers generated for a plurality of bonus game attributes and thus the less frequently, on average, that a plurality of random numbers will each be considered the designated or winning random number.

After determining which of the plurality of maintained bonus game attributes to utilize for the bonus game, as described above, the gaming system displays a bonus game and determines a bonus game award based, at least in part, on the determined bonus game attribute.

In another embodiment, rather than randomly generating a number for each occurrence of a bonus game attribute modification event, the gaming system tracks the number of occurrences of each bonus game attribute modification event. In this embodiment, upon the gaming system determining that the bonus game triggering event occurs, the gaming system randomly generates a number from a predefined range of numbers for each tracked bonus game attribute modification event which occurred.

In one embodiment, since only one random number matters for each bonus game attribute, there is no need to store the entire list of random numbers generated for each bonus game attribute. In this embodiment, the gaming system only needs to store one random number for each bonus game attribute. For example, if the highest valued randomly generated number is used to determine which bonus game attribute will be utilized for the play of the triggered bonus game, the gaming system only needs to store the highest number generated for each bonus game attribute. For tie resolution, if the one stored random number is drawn more than once, each bonus game attribute will count the number of times that random number was generated.

For example, as seen in FIG. 7A, each bonus game attribute is represented as a bonus game multiplier. In this example, at a first point in time associated with an initial or reset state, no wager amounts have been placed, no random numbers have been generated (i.e. all random numbers are set to zero) and no random number is the determined highest random number for each bonus game attribute.

In one embodiment wherein the highest random number is the winning random number, as each game is played, the gaming system generates a new random number for the bonus game multiplier associated with the placed wager amount. If the new random number is higher than the current highest random number, it replaces the highest random number, and the occurrences count is set to 1. If the new random number is equal to the current random number, the occurrences count is incremented. If the new random number is less than the highest random number, that random number is discarded. In this embodiment, if a bonus game triggering event occurs, the gaming system determines which bonus game multiplier is associated with the winning random number and that bonus game multiplier is utilized for the play of the triggered bonus game. For example, as seen in FIG. 7B, after two-hundred-seventy-one wager amounts placed, the highest random number is 9918 is associated with the multiplier game multiplier of 4×. Accordingly, if the bonus game triggering event occurs before any other wager amounts are placed, the bonus game multiplier of 4× will be selected.

In one embodiment, if when the bonus game triggering event occurs, a tie exists, then the randomly generated numbers for the bonus game multipliers which did not participate in the tie are set to zero. In this embodiment, each bonus game multiplier that participated in the tie redraws the number of random numbers as dictated by its occurrences count. Those numbers are compared to determine the bonus game multiplier utilized for the play of the triggered bonus game. For example, as seen in FIG. 7C, the bonus game multiplier of 2× would draw 2 new random numbers and the bonus game multiplier of 4× would draw 1 new random number. The highest random number of those three new random numbers is used to determine which bonus game multiplier (i.e., which bonus game attribute) will be utilized for the play of the triggered bonus game.

It should be appreciated that in addition to or as an alternative to increasing the size of the predefined range of numbers to lower the frequency of a tie (as described above), in one embodiment, the gaming system reduces the frequency of a tie occurring by drawing a set of random numbers for each occurrence of a bonus game attribute modification event. In this embodiment, when a new random number set is drawn, the set is compared to the existing set, one number at a time. The gaming system compares the first numbers in each set. If the highest random number is the winning random number and the first random number of one set of random numbers is greater than another, the set with the greater number is the highest random number set. The gaming system stores the bonus game attribute associated with this random number set as the bonus game attribute that will be utilized for the play of the triggered bonus game. On the other hand, if the first numbers of the two random number sets are equal, the next number in each random number set is compared. This comparison continues until the gaming system determines that one of the random number sets is the highest random number set (and stores the bonus game attribute associated with this random number set). If each of the random numbers in each random number set are equal, the gaming system redraws a new random number set for the bonus game attribute modification event which occurred and proceeds as described above. For example, as seen in FIG. 8, the current highest random number set is associated with a bonus game multiplier of 4×. In this example, for each subsequent random number set generated (for each bonus game attribute modification event which occurs), the gaming system determined that the current highest random number set remained higher than the newly generated random number set generated. Thus, in this example, after the three random number sets are generated for the three illustrated bonus game attribute modification events which occurred, the gaming system maintained the bonus game multiplier of 4× as the bonus game attribute that would be utilized if a bonus game triggering event occurred.

In one embodiment wherein the highest random number is the winning random number, each gaming device in the gaming system maintains a listing of the highest random number generated for each bonus game attribute. In this embodiment, upon the occurrence of a bonus game triggering event, the gaming system compares the random numbers maintained by each of the gaming devices to determine which random number is the winning random number (and thus to determine which bonus game attribute will be utilized for the triggered bonus game). In another embodiment wherein the highest random number is the winning random number, the gaming system maintains a listing of the highest random number generated for each bonus game attribute for each identified player. In this embodiment, upon the occurrence of a bonus game triggering event, the gaming system compares the random numbers maintained by the gaming system for each of the players to determine which random number is the winning random number (and thus to determine which bonus game attribute will be utilized for the triggered bonus game).

Figure 9:
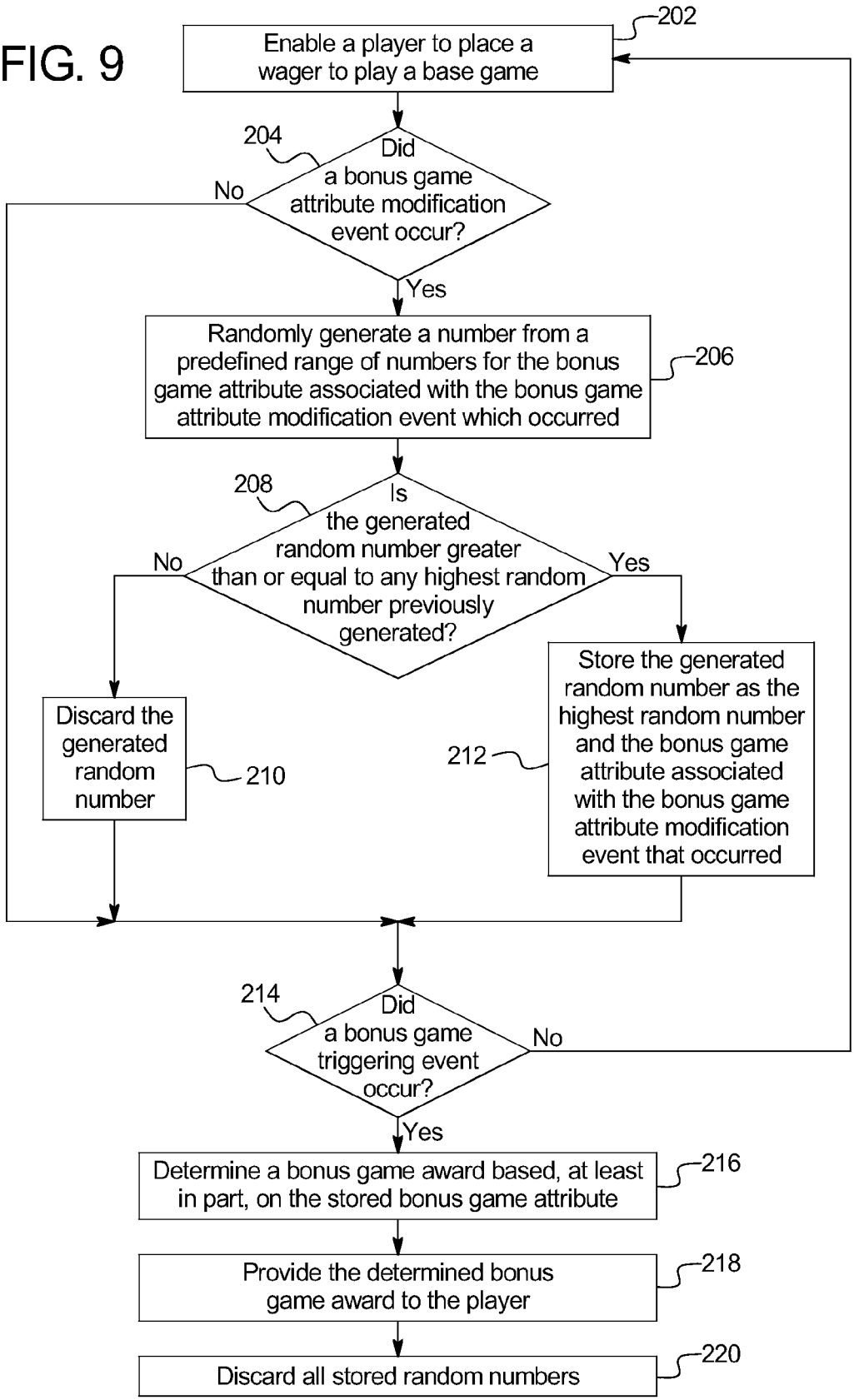
FIG. 9 is a flowchart of another embodiment of the gaming system disclosed herein illustrating a determination of a bonus game attribute to utilize for a play of a bonus game.

In another embodiment, rather than maintaining a database of which random number(s) are drawn for each bonus game attribute (and the number of occurrences such random number are drawn), the gaming system maintains a real-time count of which bonus game attribute will be utilized for the play of the triggered bonus game. In one such embodiment, as seen in FIG. 9, the gaming system enables a player to place a wager to play a base game as described above and as indicated in block 202. The gaming system determines if a bonus game attribute modification event (associated with one of a plurality of bonus game attributes) occurred in associated with the play of the game as indicated in diamond 204. If the gaming system determines that a bonus game attribute modification event occurred, as indicated in block 206, the gaming system randomly generates a number from a predefined range of numbers for the bonus game attribute associated with the bonus game attribute modification event which occurred. For example, if the bonus game attribute modification event is the placement of a wager and the player placed a wager of five credits per payline (which is associated with a bonus game attribute of a bonus game multiplier of 5×), the gaming system determines that a bonus game attribute modification event occurred and generates a random number of 4,322 from the range of 0 to 9,999 for the bonus game multiplier of 5×.

After generating a random number for the bonus game attribute associated with the bonus game attribute modification event that occurred, the gaming system determines if the generated random number is greater than or equal to any highest random number previously generated as indicated in block 208. In an alternative embodiment, the gaming system determines if the generated random number is greater than (and not greater than or equal to) any highest random number previously generated. In another embodiment, rather than determining if the generated random number is greater than a highest random number previously generated, the gaming system determines if the generated random number is less than a lowest random number previously generated (or closer to a designated number than the closest random number previously generated).

If the generated random number is less than any highest random number previously generated, the gaming system discards the generated random number as indicated in block 210. On the other hand, if the generated random number is greater than any highest random number previous generated (or is the first random number generated), as indicated in block 212, the gaming system stores the generated random number as the highest random number and the bonus game attribute associated with the bonus game attribute modification event that occurred. In a first example, if the random number of 4,322 for the bonus game multiplier of 5× is less than the highest random number of 7,445 previously generated for a bonus game multiplier of 2×, the gaming system discards the random number of 4,322 for the bonus game multiplier of 5× and does not alter the bonus game multiplier set to be used for a subsequent play of the bonus game. In a second example, if the random number of 4,322 for the bonus game multiplier of 5× is the first random number generated, the gaming system stores the random number of 4,322 as the highest random number and sets the bonus game multiplier of 5× as the bonus game multiplier to utilize for a subsequent play of the bonus game. In a third example, if the random number of 4,322 for the bonus game multiplier of 5× is greater than the highest random number of 3,490 previously generated for a bonus game multiplier of 3×, the gaming system discards the previously stored random number of 3,490 for the bonus game multiplier of 3×, stores the random number of 4,322 as the new highest random number and sets the bonus game multiplier of 5× as the new bonus game multiplier to utilize for a subsequent play of the bonus game. Such a configuration of storing only the highest random number previously generated and the bonus game attribute associated with that random number enables the gaming system to maintain a real-time count of which bonus game attribute will be utilized for the play of the triggered bonus game After determining that no bonus game attribute modification event occurred in associated with the play of the game, or after discarding the generated random number or after storing the generated random number as the highest random number and storing the bonus game attribute associated with the bonus game attribute modification event that occurred, the gaming system determines if a bonus game triggering event occurred as described above and indicated in diamond 214.

If the gaming system determines that the bonus game triggering event did not occur, the gaming system returns to block 202 and enables a player to place another wager to play the base game. On the other hand, if the gaming system determines that the bonus game triggering event occurred, as indicated in block 216, the gaming system determines a bonus game award based, at least in part, on the stored bonus game attribute. After determining a bonus game award, the gaming system provides the determined bonus game award to the player and discards all stored random numbers as indicated in block 218 and 220. Following the first example described above, if the gaming system determines that the bonus game triggering event occurred, the gaming system determines a bonus game award based, at least in part, on the stored bonus game multiplier of 2× (for the previously generated highest random number of 7,445). Following the second and third examples described above, if the gaming system determines that the bonus game triggering event occurred, the gaming system determines a bonus game award based, at least in part, on the stored bonus game multiplier of 5× (for the generated highest random number of 4,322).

In another embodiment, if a bonus game attribute modification event occurs, the random number generated for a plurality of bonus game attributes are each selected from a different predefined range of numbers. In one such embodiment, the gaming system selects random numbers from different ranges of numbers for different players of different player tracking rankings. For example, for each bonus game attribute modification event which occurs for a player associated with a gold player tracking ranking, the gaming system selects a random number from the range of 0 to 10,000. In this example, for each bonus game attribute modification event which occurs for a player associated with a platinum player tracking ranking, the gaming system selects a random a random number from the range of 0 to 9,000. In another embodiment, the gaming system selects random numbers from different ranges of numbers for different bonus game attributes. This embodiment is used to scale the probabilities of different bonus game attributes being selected to be utilized for a play of a triggered bonus game.

In another embodiment, the gaming system generates a plurality of random numbers for each bonus game attribute modification event which occurs. In this embodiment, as described above, the gaming system determines which one of the random numbers is the designated or winning random number. For example, for each bonus game attribute modification event which occurs, the gaming system randomly generates two numbers. In another embodiment, the gaming system generates one random number for each of a plurality of bonus game attribute modification events which occur. In this embodiment, as described above, the gaming system determines which one of the randomly generated numbers is the designated or winning random number.

In one embodiment, as described above, the gaming system generates the same quantity of random numbers for each bonus game attribute modification event which occurs. In another embodiment, the gaming system generates a different quantity of random numbers for one or more different bonus game attribute modification events which occur. In one such embodiment wherein each wager amount placed represents a different bonus game attribute modification event, the gaming system generates different quantities of random numbers for different wager amounts placed. For example, for a wager amount of one credit per payline, the gaming system generates one random number associated with a bonus game multiplier of 1×, for a wager amount of two credits per payline, the gaming system generates one random number associated with a bonus game multiplier of 2×, for a wager amount of three credits per payline, the gaming system generates two random numbers associated with a bonus game multiplier of 3×, for a wager amount of four credits per payline, the gaming system generates two random numbers associated with a bonus game multiplier of 4×, and for a wager amount of five credits per payline, the gaming system generates three random numbers associated with a bonus game multiplier of 5×. Such an embodiment provides players an additional incentive for placing greater wager amount per payline (to increase the probability that the random number generated in associated with the higher valued bonus game attributes will be the designated or winning random number).

In an alternative embodiment, the gaming system determines which bonus game attributes to utilize for the triggered bonus game by drawing a random number from a range of one to the total number of bonus game attribute modification events which occurred since the last bonus game. The gaming system assigns each bonus game attribute a separate range of numbers equal to the number of bonus game attribute modification events which occurred in association with that bonus game attribute. In this embodiment, the gaming system forms a total range of numbers from the separate ranges of numbers and randomly generates a number from this total range of numbers. The gaming system determines that the bonus game attribute assigned to the range of numbers in which the drawn random number falls is used for the play of the triggered bonus game.

In another embodiment, the gaming system determines which bonus game attribute to utilize for the play of the triggered bonus game by drawing a random number from a set or total range of numbers. The gaming system assigns each bonus game attribute a separate range of numbers based on the number of bonus game attribute modification events which occurred in association with that bonus game attribute proportional to the total quantity of bonus game attribute modification events which occurred since the last bonus game. In this embodiment, the gaming system determines that the bonus game attribute assigned to the separate range of numbers in which the drawn random number falls is utilized for the play of the bonus game.

In one embodiment, a bonus game attribute modification event occurs and/or a bonus game triggering event occurs based on one or more game play events, such as a symbol-driven trigger. In other embodiments, the bonus game attribute modification event occurs and/or a bonus game triggering event occurs based on exceeding a certain amount of game play (such as number of games, number of credits, or elapsed amount of time), or based on reaching a specified number of points earned during game play.

In another such embodiment, the bonus game attribute modification event occurs and/or a bonus game triggering event occurs based on a random trigger or on an apparently random trigger. In one such embodiment, the gaming system does not provide any apparent reasons to the player for the occurrence of the bonus game attribute modification event or the occurrence of the bonus game triggering event, wherein such events are not based on any event in any of the plays of any primary games or on any of the plays of any secondary game of the gaming system. That is, the bonus game attribute modification event occurs and/or a bonus game triggering event occurs without any explanation or alternatively with simple explanations. In another embodiment, the bonus game attribute modification event occurs and/or a bonus game triggering event occurs at least partially based on a game event, such as a symbol-driven trigger, and at least partially based on a non-game play event, such as a random event.

In one such embodiment, the occurrence of the bonus game attribute modification event and/or the occurrence of the bonus game triggering event is randomly determined, wherein different players are assigned different chances of obtaining a bonus game attribute modification event and/or triggering the bonus game based on their respective wager levels. In another embodiment, the occurrence of the bonus game attribute modification event and/or the occurrence of a bonus game triggering event is randomly determined, wherein different games played (or gaming devices played) are assigned different chances of obtaining a bonus game attribute modification event and/or different chances of triggering a bonus game. In another embodiment, the occurrence of the bonus game attribute modification event and/or the occurrence of triggering a bonus game is randomly determined, wherein different denomination gaming devices are assigned different chances of obtaining a bonus game attribute modification event and/or different chances of triggering the bonus game.

In one such embodiment, the bonus game attribute modification event occurs and/or a bonus game triggering event occurs based on at least one accumulated value progressive award incremented to a progressive award hit value. In this embodiment, the gaming system includes one or more accumulated value progressive awards or Nth coin progressive awards. Such accumulated value progressive awards are driven by an amount of wagers placed or a suitable coin-in amount. In one such embodiment, each accumulated value progressive award is associated with a range of values, wherein a bonus game attribute modification event will occur and/or a bonus game triggering event occurs when the progressive award increments to a progressive award hit value within the range of values associated with that progressive award. That is, when an accumulated value progressive award increases to a determined progressive award hit value, a bonus game attribute modification event will occur and/or a bonus game triggering event occurs. In this embodiment, after the accumulated value progressive award causes a bonus game attribute modification event to occur and/or a bonus game triggering event occurs, the accumulated value progressive award is reset to a default value and starts incrementing from the default progressive award level.

In another such embodiment, the bonus game attribute modification event occurs and/or a bonus game triggering event occurs based on time. In this embodiment, a time is set for when a bonus game attribute modification event and/or a bonus game triggering event occurs will occur. In one embodiment, such a set time is based on historic data. In one such embodiment, if previous bonus game attribute modification events and/or previous bonus game triggering event have occurred after approximately thirty-seven minutes, a bonus game attribute modification event and/or a bonus game triggering event is set to trigger thirty-seven minutes from the conclusion of the previous bonus game attribute modification event and/or from the conclusion of the previous bonus game triggering event. In one embodiment, a suitable algorithm is implemented to determine the player who wagered at or closest to this time with tie-breaking based on any number of factors (e.g., player tracking history, amount of or recent wagers placed).

In another such embodiment, the bonus game attribute modification event occurs and/or a bonus game triggering event occurs based on a predefined variable reaching a defined parameter threshold. In different embodiments, the predefined parameter thresholds include a length of time, a length of time after a certain dollar amount is hit, a wager level threshold for the gaming system (which gaming device is the first to contribute $250,000), a number of gaming machines in the gaming system active, or any other parameter that would define a threshold for the occurrence of the bonus game attribute modification event and/or a bonus game triggering event.

In another such embodiment, the bonus game attribute modification event occurs and/or a bonus game triggering event occurs after a random number of plays in which a bonus game attribute modification event and/or a bonus game triggering event has not occurred. In another alternative embodiment, the gaming system determines if a bonus game attribute modification event occurs and/or a bonus game triggering event occurs based upon gaming system operator defined player eligibility parameters stored on a player tracking system (such as via a player tracking card or other suitable manner). For example, a gaming system operator may choose to only enable players of the highest player tracking status to be eligible for a bonus game attribute modification event and/or a bonus game triggering event. In this embodiment, the parameters for eligibility are defined by the gaming system operator based on any suitable criterion. In one embodiment, the central controller/gaming device processor recognizes the player's identification (via the player tracking system) when the player inserts their player tracking card in the gaming machine. The gaming system/gaming device processor determines the player tracking level of the player and if the current player tracking level defined by the gaming system operator is eligible for the bonus game attribute modification event and/or a bonus game triggering event. In one embodiment, the gaming system operator defines minimum bet levels required for the bonus game attribute modification event and/or a bonus game triggering event based on the player's card level. In this embodiment, different bet amounts are required to be eligible for different bonus game attribute modification events and/or different bonus game triggering events. In another embodiment, as described above, different side bets or side-wager amounts are required to be eligible for different bonus game attribute modification events and/or different bonus game triggering events. Once the central controller/gaming device processor determines which players are eligible, any suitable method for determining if a bonus game attribute modification event occurs and/or a bonus game triggering event occurs may be employed.

In another such embodiment, the occurrence of the bonus game attribute modification event and/or the occurrence of a bonus game triggering event includes a system determination which is based on a random selection by the central controller. In one embodiment, the central controller tracks all active gaming systems and the wagers they placed. Each gaming system has its own entry defining its state as either active or inactive and also defining the values of the wagers from that gaming system. In one embodiment, active status means that the gaming system is being actively played by a player and enrolled/inactive status means that the gaming system is not being actively played by a player. The active status requirements can be based on any suitable number of satisfied criteria or defined in any suitable manner by the implementer of the gaming system. In one embodiment, a play of or wager on the primary game of the gaming system within a predetermined period of time is part of the determination of whether that gaming system is in the active status. Other factors such as: (a) the amount of time between each play of or wager on the primary game of the gaming system; (b) the amount being wagered on the primary game(s); and (c) the number of plays within a period of time, may also or alternatively be part of the determination of whether a gaming system is in the active status; (d) the existence of credits on the gaming system may also or alternatively be part of the determination of whether a gaming system is in the active status.

In one such embodiment, based on the gaming machine's state as well as one or more wager pools associated with the gaming machine, the central controller determines if a bonus game attribute modification event occurs and/or a bonus game triggering event occurs for one or more gaming devices. In one embodiment, a bonus game attribute modification event occurs and/or a bonus game triggering event occurs for the gaming machine which has been classified as active the longest since the last triggering event. In another embodiment, a bonus game attribute modification event occurs and/or a bonus game triggering event occurs based on the relative proportion of gaming/wagering activity at each gaming device in the gaming system. In this embodiment, a bonus game attribute modification event and/or a bonus game triggering event is more likely to occur for the player who consistently places a higher wager than a player who consistently places a minimum wager.

In another embodiment, the central controller determines, in cooperation with the gaming system, when to cause a bonus game attribute modification event to occur and/or when to cause a bonus game triggering event to occur by utilizing one or more random number generators. In this embodiment, the central controller determines when to cause the bonus game attribute modification event and/or bonus game triggering event to occur by determining if any numbers allotted to a gaming system match a randomly selected number. In one such embodiment, upon or prior to each play of the game, a random number is selected from a range of numbers and during each primary game, the gaming system allocates the first N numbers in the range, where N is the number of credits bet by the player in that primary game. At the end of the primary game, the randomly selected number is compared with the numbers allocated to the player and if a match occurs, the gaming system causes a bonus game attribute modification event to occur and/or a bonus game triggering event to occur. It should be appreciated that any suitable manner of causing the bonus game attribute modification event to occur and/or causing a bonus game triggering event to occur may be implemented with the gaming system disclosed herein.

In one embodiment, the central controller and an individual gaming machine work in conjunction with each other to determine when a bonus game attribute modification event occurs and/or a bonus game triggering event occurs, for example through an individual gaming machine meeting a predetermined requirement or criteria established by the central controller. In another embodiment, an individual gaming machine may determine when one or more bonus game attribute modification events occur and/or when one or more bonus game triggering events occur. In another embodiment, an individual gaming machine may determine when at least one bonus game attribute modification event and/or bonus game triggering event occurs and the central controller determines when at least one bonus game attribute modification event and/or bonus game triggering event occurs. It should be appreciated that any suitable determination of how and when one or more bonus game attribute modification events occur and/or one or more bonus game triggering events occur may be implemented in accordance with the gaming system disclosed herein.

It should be appreciated that in different embodiments, the gaming system disclosed herein is configured such that any combination of one or more of the determinations of:

a. the initial or reset probability of being selected associated with each of the bonus game attributes of the maintained table,
b. if a bonus game attribute modification event occurs,
c. the amount the probabilities associated with the different bonus game attributes are modified upon a bonus game attribute modification event,
d. if a bonus game triggering event occurs,
e. which bonus game attribute will be utilized for the play of the triggered bonus game,
f. the type of bonus game displayed to one or more of the players at the gaming devices,
g. the features incorporated into any displayed bonus games,
h. which bonus game attributes of the maintained table to reset upon a bonus game triggering event,
i. how to modify the bonus game attributes upon a bonus game triggering event,
j. which of a plurality of databases is selected for the play of the triggered bonus game,
k. which predefined range of numbers will be utilized to select one or more random numbers,
l. the progressive award hit value at which an accumulated value progressive award causes a bonus game attribute modification event to occur
m. the progressive award hit value at which an accumulated value progressive award causes a bonus game triggering event to occur,
n. the quantity of random numbers generated for each bonus game attribute modification event which occurs, and/or
o. any other determination made by the gaming system disclosed herein can be predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

As indicated above, bonus game attribute modification events and/or a triggering of the bonus game may be provided to the players of the gaming machines with or without explanation or information provided to the player, or alternatively information can be displayed to the player. In one embodiment, suitable information about the bonus game attribute modification events and/or a triggering of the bonus game can be provided to the players through one or more displays on the gaming machines or additional information displays positioned near the gaming machines, such as above a bank of system gaming machines. In one embodiment, a metering and/or information display device may be used to display information regarding the bonus game attribute modification events and/or a triggering of the bonus game. This information can be used to entertain the player or inform the player that a bonus game attribute modification event and/or a bonus game triggering event has occurred or will occur. Examples of such information are that a bonus game attribute modification event has occurred and that a bonus game attribute modification event will shortly be provided (i.e., the foreshadowing of a bonus game attribute modification event), and a number of games played/total time since the last bonus game attribute modification event occurred. It should be appreciated that such information can be provided to the players through any suitable audio, audio-visual or visual devices.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming system comprising:

at least one processor;

at least one input device;

at least one display device; and at least one memory device which stores a plurality of instructions, which when executed by the at least one processor, cause the at least one processor to operate with the at least one display device and the at least one input device to:

(a) receive a first input of a selected quantity of paylines to wager on in association with a play of a base game, (b) receive a second input of a selected amount to wager on each of the selected quantity of paylines, wherein a wager configuration of the selected quantity of paylines to wager on and the selected amount to wager on each of the selected quantity of paylines is associated with a bonus game having an average expected payout and a probability of being selected and different wager configurations are associated with different average expected payouts and different probabilities of being selected, (c) modify a probability of being selected of the bonus game associated with the wager configuration of the selected quantity of paylines to wager on and the selected amount to wager on each of the selected quantity of paylines, (d) determine if a bonus game triggering event occurs, (e) if the bonus game triggering event does not occur, repeat (a) to (e) until the bonus game triggering event occurs, and (f) if the bonus game triggering event occurs at a designated point in time:

(i) randomly select one of the bonus games, said random selection based on the probabilities associated with each of the bonus games at the designated point in time, (ii) randomly determine a bonus game award in association with a play of the selected bonus game, and (iii) display to a player the determined bonus game award.

2. The gaming system of claim 1, wherein when executed by the at least one, processor upon receipt of the first input of the selected quantity of paylines to wager on in association with the play of the base game and the second input of the selected amount to wager on each of the selected quantity of paylines, the plurality of instructions cause the at least one processor to modify the probability of being selected associated with at least one of the bonus games not associated with the wager configuration of the selected quantity of paylines to wager on and the selected amount to wager on each of the selected quantity of paylines.

3. The gaming system of claim 2, wherein which probability associated with at least one of the bonus games not associated with the wager configuration of the selected quantity of paylines to wager on and the selected amount to wager on each of the selected quantity of paylines is modified is based on a total wager amount placed in association with the play of the base game.

4. The gaming system of claim 1, wherein each wager configuration is associated with a bonus game modification event.

5. The gaming system of claim 1, wherein the determination that the bonus game triggering event will occur is independent of any displayed event in any play of any base game.

6. The gaming system of claim 1, wherein when executed by the at least one processor after displaying to the player the determined bonus game award, the plurality of instructions cause the at least one processor to reset any modified probabilities associated with the bonus games to a designated probability.

7. The gaming system of claim 1, wherein the determined bonus game award includes at least one selected from the group consisting of: a quantity of monetary credits, a quantity of non-monetary credits, a quantity of promotional credits, and a quantity of player tracking points.

8. A gaming system server comprising:

at least one processor; and at least one memory device which stores a plurality of instructions, which when executed by the at least one processor, cause the at least one processor to:

(a) receive a first input of a selected quantity of paylines to wager on in association with a play of a base game, (b) receive a second input of a selected amount to wager on each of the selected quantity of paylines, wherein a wager configuration of the selected quantity of paylines to wager on and the selected amount to wager on each of the selected quantity of paylines is associated with a bonus game having an average expected payout and a probability of being selected and different wager configurations are associated with different average expected payouts and different probabilities of being selected, (c) modify a probability of being selected of the bonus game associated with the wager configuration of the selected quantity of paylines to wager on and the selected amount to wager on each of the selected quantity of paylines, (d) determine if a bonus game triggering event occurs, (e) if the bonus game triggering event does not occur, repeat (a) to (e) until the bonus game triggering event occurs, and (f) if the bonus game triggering event occurs at a designated point in time:

(i) randomly select one of the bonus games, said random selection based on the probabilities associated with each of the bonus games at the designated point in time, (ii) randomly determine a bonus game award in association with a play of the selected bonus game, and (iii) cause at least one display device to display to a player the determined bonus game award.

9. The gaming system server of claim 8, wherein when executed by the at least one processor upon receipt of the first input of the selected quantity of paylines to wager on in association with the play of the base game and the second input of the selected amount to wager on each of the selected quantity of paylines, the plurality of instructions cause the at least one processor to modify the probability of being selected associated with at least one of the bonus games not associated with the wager configuration of the selected quantity of paylines to wager on and the selected amount to wager on each of the selected quantity of paylines.

10. The gaming system server of claim 9, wherein which probability associated with at least one of the bonus games not associated with the wager configuration of the selected quantity of paylines to wager on and the selected amount to wager on each of the selected quantity of paylines is modified is based on a total wager amount placed in association with the play of the base game.

11. The gaming system server of claim 8, wherein each wager configuration is associated with a bonus game modification event.

12. The gaming system server of claim 8, wherein the determination that the bonus game triggering event will occur is independent of any displayed event in any play of any base game.

13. The gaming system server of claim 8, wherein when executed by the at least one processor after displaying to the player the determined bonus game award, the plurality of instructions cause the at least one processor to reset any modified probabilities associated with the bonus games to a designated probability.

14. The gaming system server of claim 8, wherein the determined bonus game award includes at least one selected from the group consisting of: a quantity of monetary credits, a quantity of non-monetary credits, a quantity of promotional credits, and a quantity of player tracking points.

15. The gaming system server of claim 8, which transmits and receives data over a data network.

16. The gaming system server of claim 15, wherein the data network is an internet.

* * * * *